US011090217B2

(12) United States Patent
Owusu

(10) Patent No.: US 11,090,217 B2
(45) Date of Patent: Aug. 17, 2021

(54) STRETCHING/MASSAGE SYSTEM, APPARATUS AND METHOD

(71) Applicant: JAXAMO UK LIMITED, Bedfordshire (GB)

(72) Inventor: Stephen Owusu, Newcastle, WA (US)

(73) Assignee: JAXAMO UK LIMITED, Bedfordshire (GB)

( * ) Notice: Subject to any disclaimer, the term of this patent is extended or adjusted under 35 U.S.C. 154(b) by 0 days.

(21) Appl. No.: 16/425,267

(22) Filed: May 29, 2019

(65) Prior Publication Data

US 2020/0375841 A1 Dec. 3, 2020

(51) Int. Cl.

| | |
|---|---|
| ***A61H 15/00*** | (2006.01) |
| ***A61H 23/00*** | (2006.01) |
| ***A61H 23/02*** | (2006.01) |
| ***A63B 23/00*** | (2006.01) |

(52) U.S. Cl.

CPC ..... *A61H 15/00* (2013.01); *A61H 23/02* (2013.01); *A63B 23/00* (2013.01); *A61H 2015/0014* (2013.01); *A61H 2015/0071* (2013.01); *A61H 2201/1261* (2013.01); *A61H 2201/501* (2013.01); *A63B 2023/006* (2013.01)

(58) Field of Classification Search

CPC ..... A61H 15/00; A61H 23/02; A61H 2015/0014; A61H 2201/501; A61H 2015/0071; A61H 2201/1261; A61H 2201/0157; A61H 2201/02; A61H 2201/0207; A61H 2201/0228; A61H 2201/1207; A61H 2201/169; A61H 2201/1692; A61H 2201/1695; A61H 2201/50; A61H 2201/5023; A61H 2201/5035; A61H 2201/5046; A63B 23/00; A63B 2023/006

See application file for complete search history.

(56) References Cited

U.S. PATENT DOCUMENTS

| | | | | |
|---|---|---|---|---|
| 5,255,188 | A * | 10/1993 | Telepko | A61H 1/02 601/23 |
| 10,058,735 | B1 * | 8/2018 | Pan | A61H 1/0244 |
| 2005/0070827 | A1 * | 3/2005 | Lee | A61H 23/0263 601/57 |
| 2005/0113724 | A1 * | 5/2005 | Wriggle | A61H 23/02 601/46 |
| 2009/0176635 | A1 * | 7/2009 | Brinson | A61H 7/001 482/141 |
| 2011/0133910 | A1 * | 6/2011 | Alarcon | A61H 19/32 340/407.1 |
| 2013/0281892 | A1 * | 10/2013 | Godfrey | A61H 15/0078 601/15 |
| 2015/0366746 | A1 * | 12/2015 | Ashby | A61H 23/02 601/49 |
| 2016/0151238 | A1 * | 6/2016 | Crunick | A61H 23/0218 601/2 |
| 2016/0310353 | A1 * | 10/2016 | Barasch | A61H 19/00 |

(Continued)

*Primary Examiner* — Quang D Thanh

(74) *Attorney, Agent, or Firm* — RatnerPrestia

(57) ABSTRACT

A vibrating roller that can be used for a stretching regimen/massage after exercise. A user may input a user profile (height, weight, fitness level) and the exercise and intensity level of the vibration desired. The roller can determine the appropriate vibration regime/massage and intensity of vibration and vibration duration that results in an effective recovery from the exercise.

21 Claims, 17 Drawing Sheets

(56) References Cited

U.S. PATENT DOCUMENTS

| | | | | |
|---|---|---|---|---|
| 2017/0143583 | A1* | 5/2017 | Lin | A61H 23/02 |
| 2018/0256442 | A1* | 9/2018 | Lee | A61H 15/0078 |
| 2019/0110947 | A1* | 4/2019 | Ekema | A61F 7/02 |

* cited by examiner

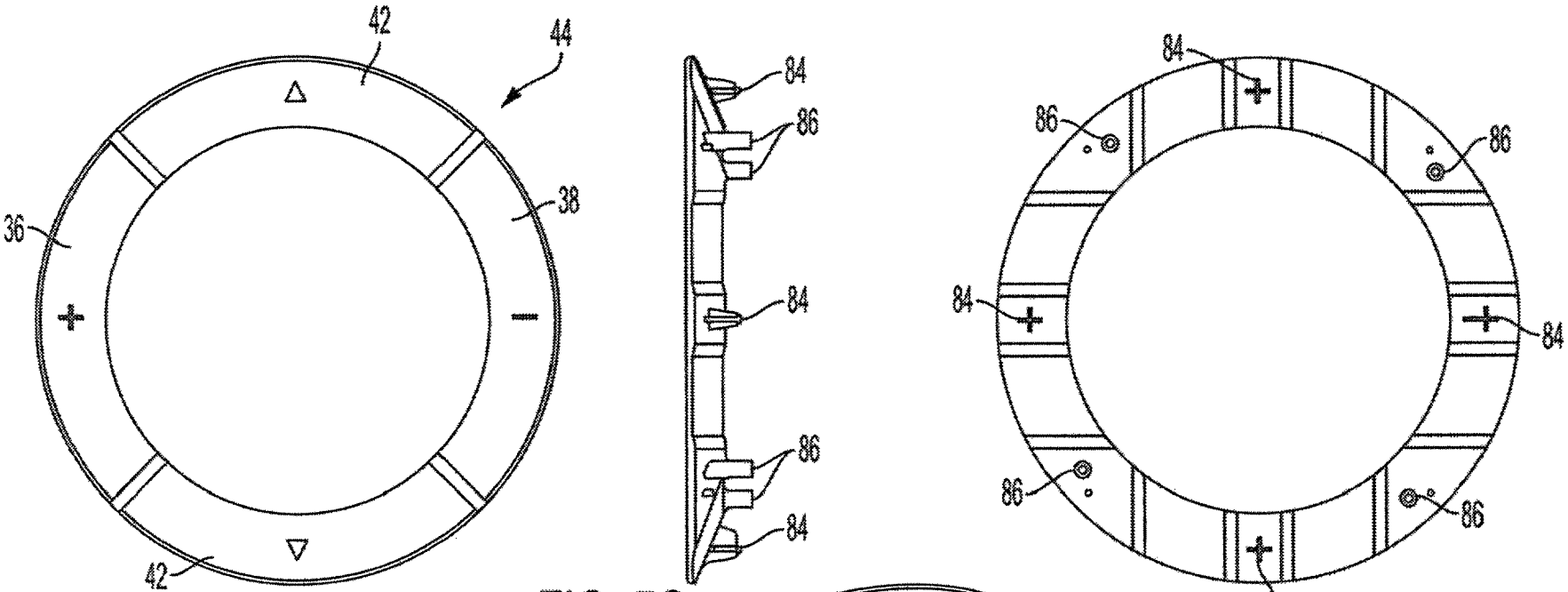
FIG. 5A
FIG. 5C
FIG. 5E
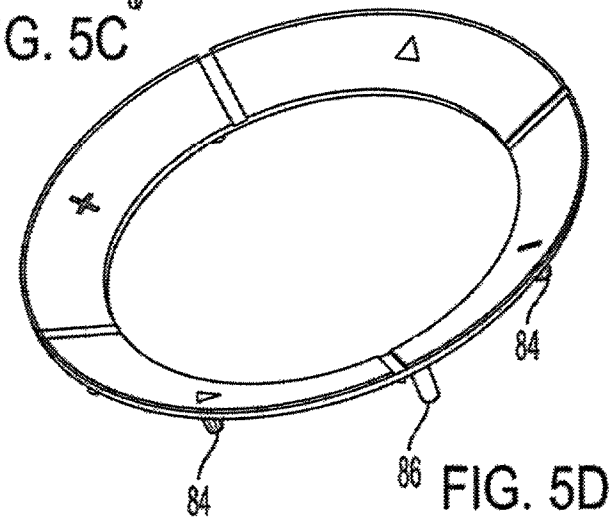
FIG. 5D
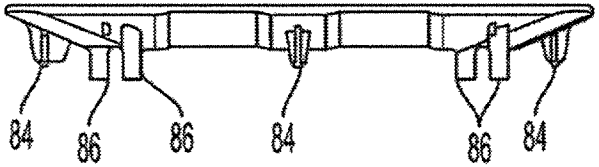
FIG. 5B

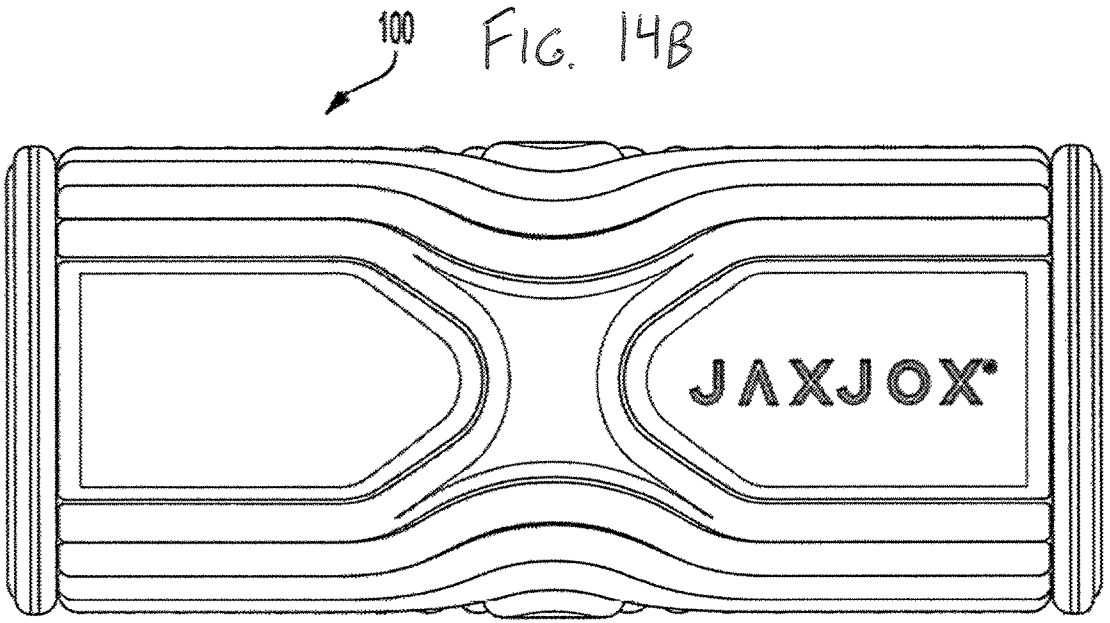
FIG. 14B
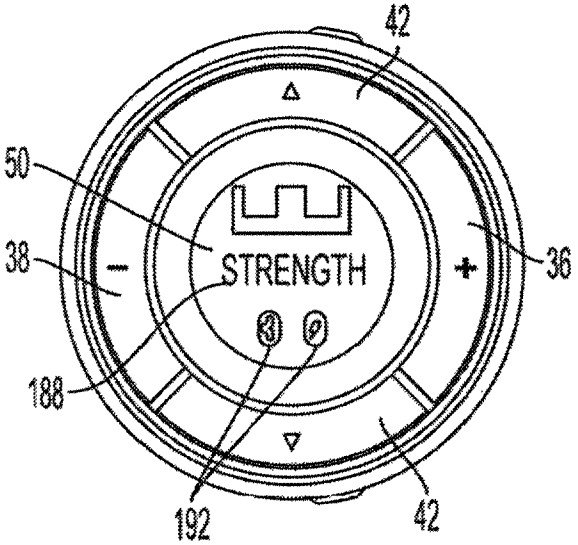
FIG. 14A
FIG. 14

STRETCHING/MASSAGE SYSTEM, APPARATUS AND METHOD

FIELD OF THE INVENTION

The present invention relates generally to an apparatus such as a roller that massages and stretches muscles after exercise, and a system and method for stretching or massaging muscles.

BACKGROUND OF THE INVENTION

Strenuous exercise can cause or exacerbate sore muscles. Massage is a method of accelerating the rate of muscle healing or recovery from sore muscles. The length of time and the intensity of a massage session may be related to improved recovery and athletic performance, depending on the intensity of the exercise that the athlete is recovering from.

However, many amateur athletes do not have access to professional massage or stretching services or to guidance regarding an optimal massage or stretching regimens.

Foam rolling is a method of self-massage/stretching that may improve athletic performance and flexibility and reduce post-workout soreness and muscle pain. Thus, a conventional foam roller can be used as a self-massage/stretching device, but does not cure the need for specialized knowledge of how to tailor a massage/stretching session to the immediate needs of the athlete, which can change daily.

SUMMARY OF THE INVENTION

Disclosed is roller for use during a stretching regimen which comprises a cylindrical body having an exterior surface configured for contact with a user of the roller. The cylindrical body at least partially defines an interior of the cylindrical body. An electro-mechanical motor is positioned at least partially within the interior of the cylindrical body, and is configured to vibrate the cylindrical body based on a vibratory control signal. A user input device is associated with the cylindrical body and is configured for receiving at least one selection. The selection is a physical fitness activity, an intensity level of a vibration, a user profile, and combinations thereof. A network communication interface is also positioned at least partially within the interior of the cylindrical body and is configured to wirelessly communicate with a remote computing device over a network. Also part of the roller is a processor coupled to the electro-mechanical motor, the user input, and the network communication interface. A memory is coupled to the processor. In addition, a stretching regimen program can be executed by the processor. Execution of the stretching regimen configures the roller to receive the at least one selection from the user, via the user input device. Execution of the stretching regimen configures the roller to transmit, over the network, to the remote computing device the at least one selection. Execution of the stretching regimen configures the roller to receive, over the network, from the remote computing device, stretching regimen control data to drive the electro-mechanical motor based on the at least one selection, adjust a vibratory control signal to the electro-mechanical motor based on the stretching regimen control data to vibrate at least a portion of the cylindrical body, and transmit, over the network, to the remote computing device, data to indicate the completion or incompletion of the stretching regimen.

Also disclosed is a roller for use during a stretching regimen. The roller comprises a cylindrical body which has an exterior surface configured for contact with a user of the roller. The cylindrical body at least partially defines an interior. The roller comprises an electro-mechanical motor to vibrate the cylindrical body based on a vibratory control signal. A network communication interface is positioned within the interior of the cylindrical body. The roller has a receiver configured to receive data corresponding to user attributes associated with the user. The roller has a transmitter configured to transmit data corresponding to user attributes and data corresponding to the specific stretching regimen attributes. The roller also has a memory positioned at least partially within the interior of the cylindrical body which is configured to store a plurality of stretching regime programs. Each of the plurality of stretching regimen programs has characteristics that are varied based on the user attributes. The roller also has a processor positioned at least partially within the interior of the cylindrical body. The processor is coupled to the network communication interface and to the memory. The processor is configured to select the stretching regimen program from among the plurality of stretching regimen programs stored in the memory based on the user attributes of the user of the roller. The processor is also configured to execute the selected stretching regimen program. The stretching regimen program includes sending the vibratory control signal to the electro-mechanical motor to control a vibration of at least a portion of the cylindrical body.

Also disclosed is a roller for use during a stretching regimen. The roller comprises a cylindrical body which has an exterior surface configured for contact with a user of the roller. The exterior surface of the cylindrical body defines a plurality of protrusions extending radially outwardly from the cylindrical body. The plurality of protrusions includes at least three groups of protrusions. Each of the groups of protrusions has at least one protrusion that is shaped differently from at least one protrusion of the other groups of protrusions. The different shapes of the plurality of protrusions are selected to provide a different contact with the user.

A method of providing a stretching regimen to a user is also disclosed. The method comprises the steps of:

a) Receiving from the user at least one criteria associated with the stretching regimen. The criteria is selected from among a physical fitness activity, an intensity level of a vibration, a user profile, and combinations thereof.

b) Selecting the stretching regimen from among a group of predetermined stretching regimens stored in a memory. The selection is based on the at least one criteria.

c) Transmitting a signal which corresponds to the selected stretching regimen to a vibration motor of a stretching roller.

d) Activating the vibration motor of the stretching roller to generate vibration corresponding to the selected stretching regimen.

e) Transmitting a signal indicating the completion or incompletion of the stretching regimen.

BRIEF DESCRIPTION OF THE DRAWINGS

The invention is best understood from the following detailed description when read in connection with the accompanying drawings. When a plurality of similar elements are present, a single reference number may be assigned to the plurality of similar elements. If the same element appears on more than one drawing it will have the same reference number.

It is emphasized that, according to common practice, the various features of the drawings are not necessarily rendered to scale. On the contrary, the dimensions of the various features may be arbitrarily expanded or reduced for clarity.

Included in the drawings are the following figures:

FIG. 1 depicts a perspective view of an embodiment of the roller;

FIGS. 2A-2G depict views of the foam exterior surface of the embodiment of the roller illustrated in FIG. 1;

FIG. 3 shows an exploded view of an embodiment of the embodiment of the roller illustrated in FIG. 1;

FIGS. 4A and 4B show aspects of a display lens of the embodiment of the roller illustrated in FIG. 1;

FIGS. 5A-5E show aspects of a button of the embodiment of the roller illustrated in FIG. 1;

FIGS. 6A-6H show aspects of a button backing plate of the embodiment of the roller illustrated in FIG. 1;

FIGS. 7A-7I show aspects of an inner core housing of the embodiment of the roller illustrated in FIG. 1;

FIGS. 8A-8C show aspects of a motor holder of the embodiment of the roller illustrated in FIG. 1;

FIGS. 9A-9B show aspects of a foam supporting tube of the embodiment of the roller illustrated in FIG. 1;

FIGS. 10A-10F show aspects of a foam exterior surface of the embodiment of the roller illustrated in FIG. 1;

FIGS. 11A-11F show aspects of a plastic end cap of the embodiment of the roller illustrated in FIG. 1;

Figure 1:
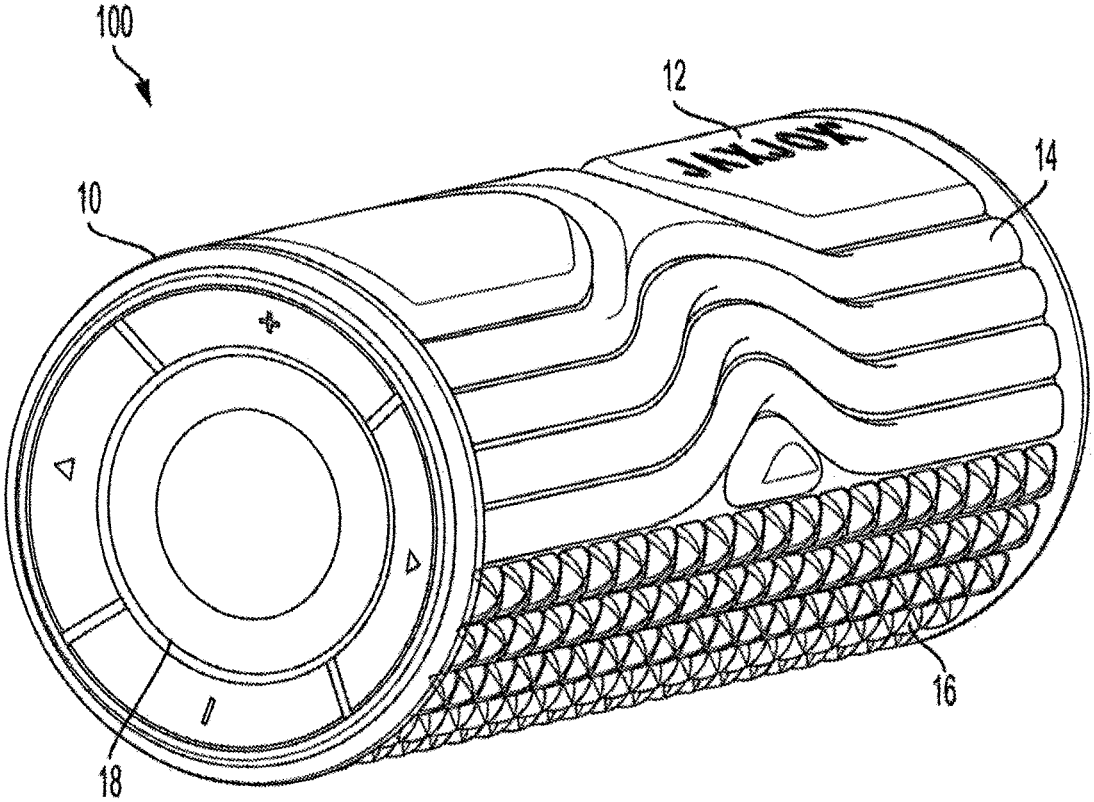
Figure 12A:
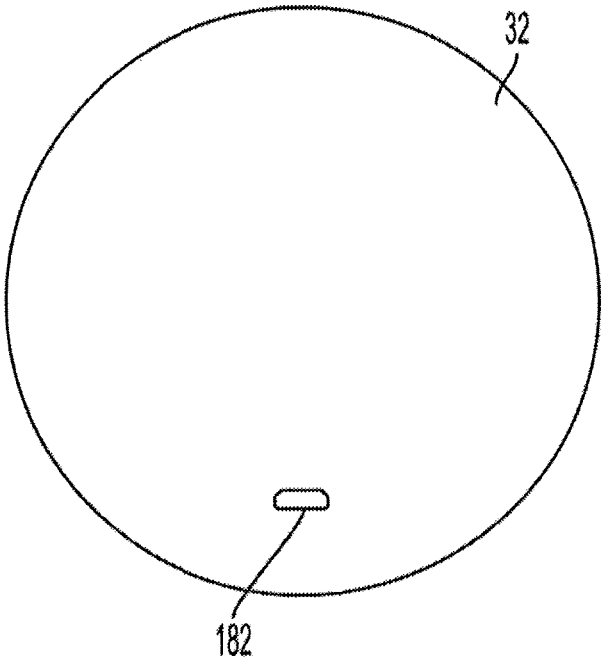
Figure 12B:
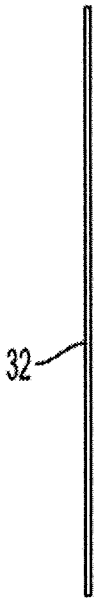
Figure 13A:
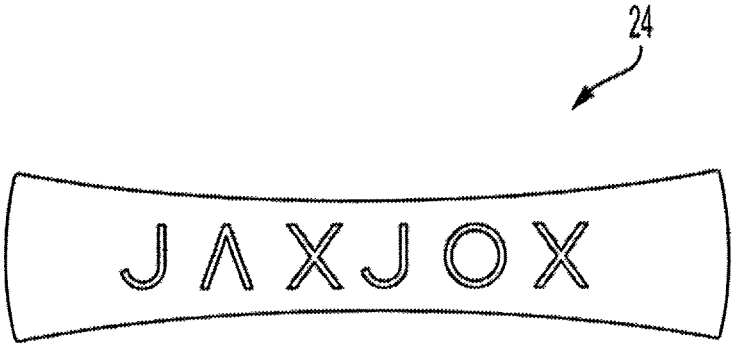
Figure 13B:
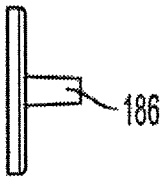
Figure 13C:
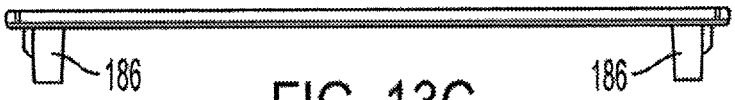
Figure 13D:
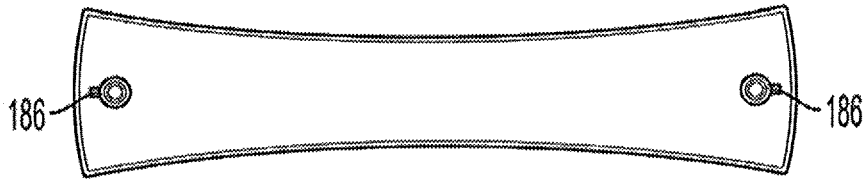
Figure 15:
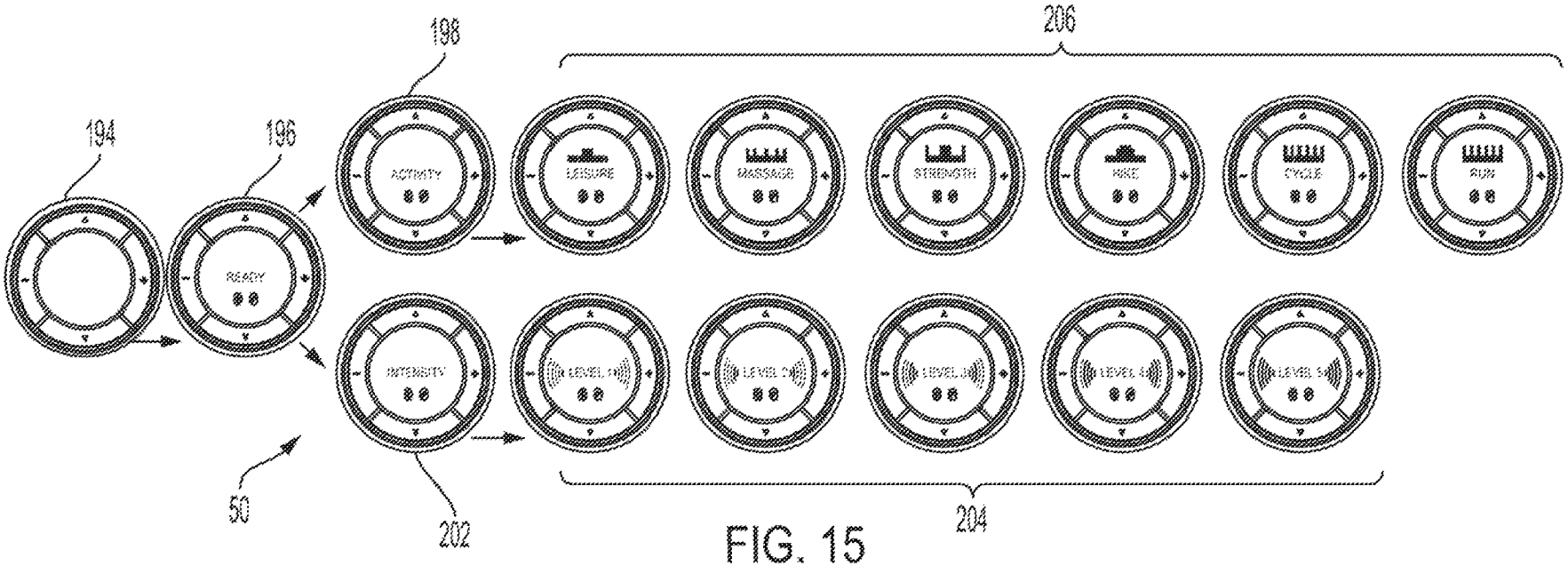
Figure 16:
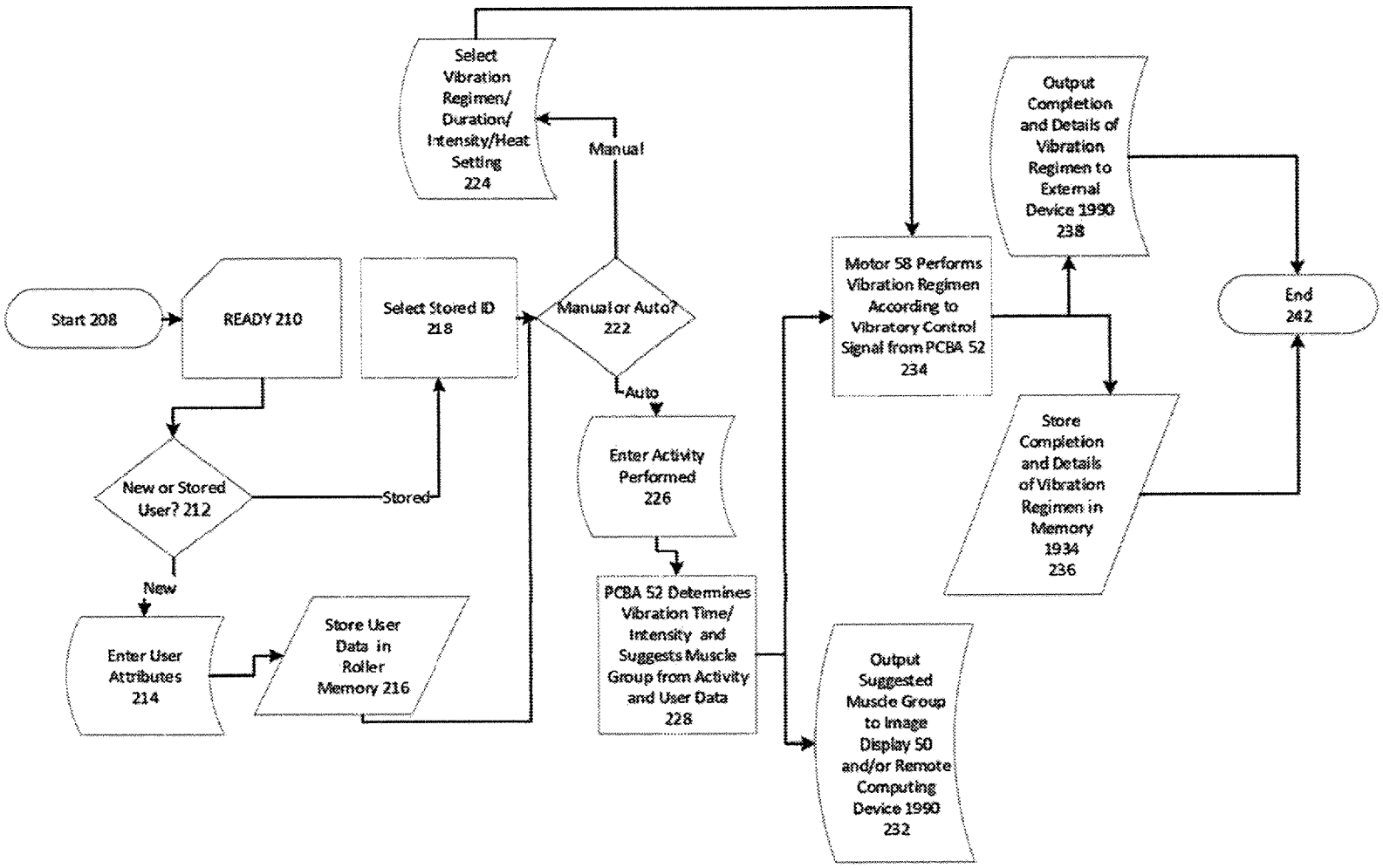

FIGS. 12A and 12B show aspects of another display lens of the embodiment of the roller illustrated in FIG. 1;

FIGS. 13A-13D show aspects of a handle of the embodiment of the roller illustrated in FIG. 1;

FIGS. 14A and 14B show aspects of the embodiment of the roller illustrated in FIG. 1, with a selected display;

FIG. 15 shows aspects of displays of the embodiment of the roller illustrated in FIG. 1;

FIG. 16 shows a diagram of the logic in of an embodiment of the roller; and

Figure 17:
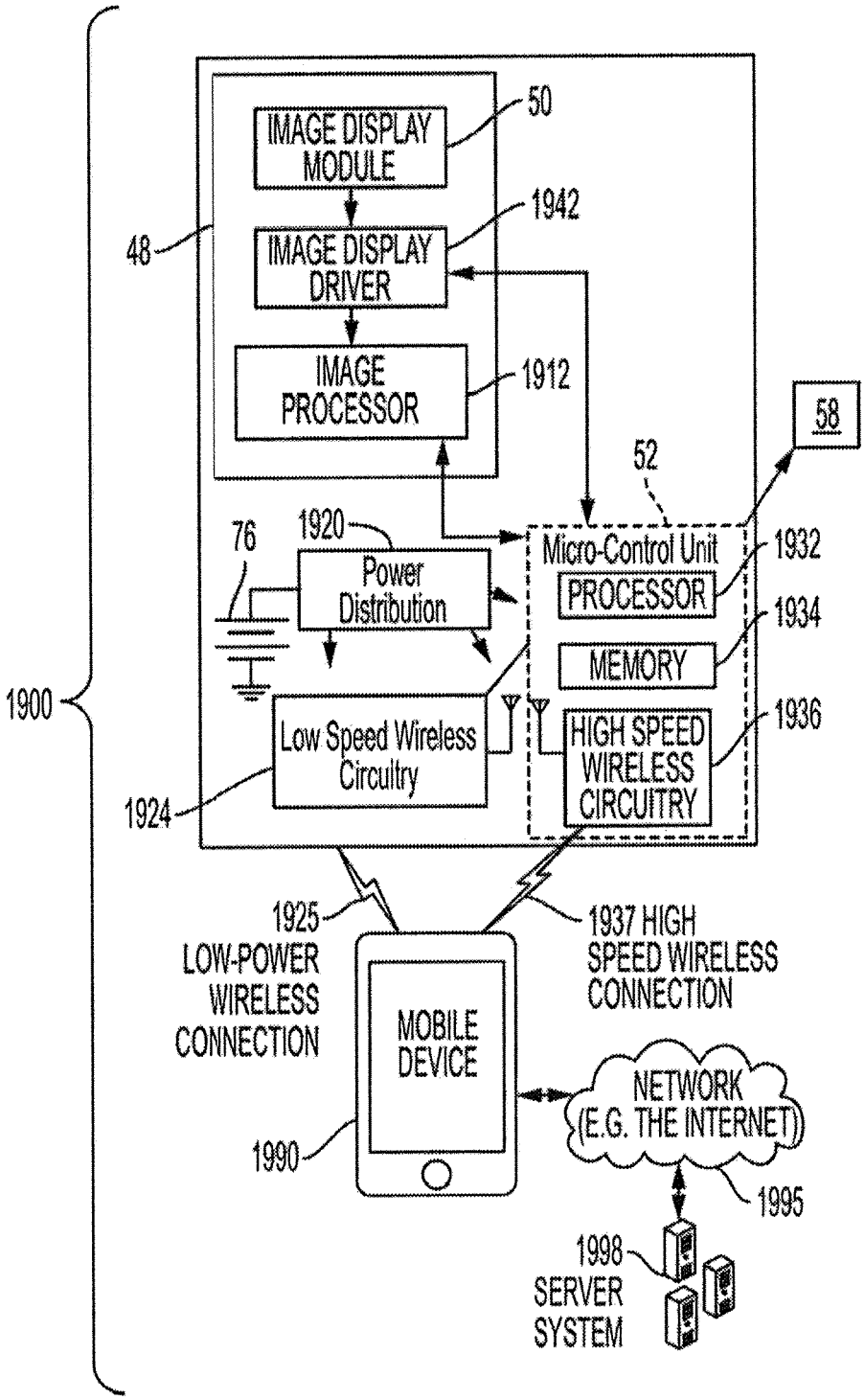

FIG. 17 shows a diagram of an embodiment of a system with which the roller illustrated in FIG. 1 can be used

DETAILED DESCRIPTION OF EMBODIMENTS OF THE INVENTION

This invention addresses, among other things, the need of athletes such as amateur athletes for access to effective massage or stretching regimens, including their need for guidance regarding the optimum amount of time and intensity of massage/stretching regimens to recover from a workout, which can depend on the intensity of the workout as well as the personal profile of the athlete.

The invention relates to a "smart" vibrating foam roller that is used by an athlete to recover from a workout. Specifically, this invention provides a foam roller that automatically can adjust the duration and intensity of a vibration regimen massage to the personal profile data of the athlete, as well as the type of the completed workout. This invention also provides a foam roller that can accept the personal profile data, also referred to as user attributes, of the athlete from a remote computing device and use the personal profile data of the athlete to determine the appropriate duration and intensity of the vibration regimen. This disclosure also provides a foam roller that can transmit the completion of the vibration regimen to a remote computing device.

The roller comprises a generally cylindrical body and has the ability to vibrate. The roller comprises a memory that is programmed with a library of vibration regimens or settings. It should be understood that the terms "vibration regimen" and "vibration setting" as used herein should be considered to be interchangeable. The terms "massage" and "stretching regimen" as used herein should also be considered to be interchangeable. The term "stretching regimen" encompasses the particular vibration regimen and its duration together. The foam roller may optionally comprise a heating function.

The foam roller settings may include a combination of vibration intensity and pattern of vibration intensity for a period of time. As used herein, the term "vibration regimen" should be understood to encompass the pattern of vibration as a function of time. Vibration intensity should be understood to encompass the amplitude of vibration, so that a higher vibration intensity means higher amplitude. The vibration may vary over time in a set pattern such as, for instance, alternating 30 seconds at a first frequency, with 30 seconds of a second frequency. A person having skill in the art can appreciate that the pattern of frequency may be more complex than this simple example. This pattern of vibration frequency over time is referred to herein as the vibration regimen. There are therefore three primary variables related to the roller vibration that may be changed—the vibration regimen (pattern of vibration frequency), the vibration intensity (amplitude of vibration), and vibration duration (how long the vibration lasts).

Regarding the connectivity of the foam roller described herein, the foam roller may have an onboard input device, e.g. buttons, for selection from a menu of activities which the user of the roller is recovering from and the profile of the user, also referred to herein as the user attributes (e.g. height, weight, fitness level, gender). An input device for the foam roller may additionally or alternatively be a mobile device, rather than the onboard input device or mechanism.

Based on the input data, a processor in the roller may then select the appropriate stretching regimen (e.g., vibration regimen and duration) from a library programmed in the memory or processor. The processor then sends a vibratory control signal to an electro-mechanical vibration motor in the roller. The processor may also select an appropriate intensity for the vibration regimen to be performed. The vibratory control signal tells the electro-mechanical vibration motor to vibrate at the vibration regimen (pattern of vibration over a period of time) and for the appropriate duration and an appropriate intensity. The processer sends a signal back to the connected device to signal that the regimen has started and/or that it has been completed. When the stretching regimen is completed, the roller may then send a signal to the remote computing device, signaling that the regimen has been completed. The foam roller may save the beginning and completing time in an internal memory. The foam roller may have the ability to store user attributes for one or more users in the internal memory.

The exemplary foam roller vibration regimen/massage system, device, and method disclosed herein may be usable by an individual user as part of one or a series of stretching regimens or as part of an exercise regimen. In such uses, the disclosed embodiments may allow the individual user to manually select a completed physical fitness activity, and intensity level of the vibration regimen desired, the time for the vibration regimen to last (duration), a user profile, and combinations thereof. The user profile may comprise as non-limiting examples, such information as height, weight, sex, and fitness level of the user. A processor in the device or system then has the ability to select from a library of vibration regimens a suitable such vibration regimen.

The foam roller may have the ability to operate in an "auto" mode, wherein the onboard processor selects the appropriate vibration regimen and time it should last using the information entered by the user regarding the exercise that was completed as well as the user's individual information regarding age, sex, fitness level, etc. Therefore, in "auto" mode the user needs only to enter their personal information and the exercise (also called "Activity") that was completed. The user's personal information may be entered at the time of use, or be stored in a memory onboard the roller. Using this information, the processor then determines the appropriate vibration regimen and how long the vibration regimen should last. The processor may optionally determine a muscle group that the roller should be applied to during the vibration regimen. The processor would then send a signal to a display module telling the display module to display the appropriate muscle group. The processor may also or alternatively send such a signal to an external computing device, e.g. a smart phone or other mobile device.

The foam roller may also or alternatively have the ability to operate in "manual" mode. In "manual" mode, the user would have the ability to select a desired vibration regimen and the length of time (duration) that the vibration regimen should last, as well the intensity (average intensity). In both auto and manual mode, the details (which vibration regimen and how long it lasted and the average intensity) of the stretching regimen performed are stored in memory onboard the roller and may also or alternatively be sent to an external computing device.

Finally, it should be understood that while the exemplary foam roller as described in detail herein has an onboard display and input devices, the display and input device may be an external computing device, via wireless connectivity, such as Bluetooth® or Wi-Fi (IEEE 802.11x).

Referring now to the drawings, FIG. 1 shows a perspective view of an embodiment of an apparatus in the form of a foam roller 100. As can be seen in FIG. 1, the foam roller 100 is a generally cylindrical body in shape, as befits an item intended to be used in a rolling manner. The overall dimensions of the foam roller 100 may vary depending on the height and weight of the user and the intended intensity of stretching desired. Various sizes and aspect ratios (e.g., diameter to length) of the roller are contemplated.

The roller 100 has an exterior surface 10 which extends around the sides of its cylindrical form. The exterior surface 10, which may be made of a polymeric or plastic foam or other firm or soft resilient material, comprises a plurality of three different protrusions or protrusion types. One of the protrusion types is generally flat palm protrusions 12, which are intended to mimic the palms or palm of the hand of a human masseuse. Another of the types of protrusions are knuckle protrusions 14, which are intended to mimic the knuckles of the hand or hands of a masseuse. Finally, the surface 10 also comprises finger protrusions 16, which are intended to mimic the fingers of the hand or hands of a masseuse.

This outer surface 10 may be made of soft or firm plastic or plastics or a foamed material or materials or a combination of foamed and unfoamed such materials as are known in the art, and which can be formed into the various protrusions as shown. The outer surface 10 is advantageously made of a polymeric material such as ethylene-vinyl acetate copolymer (EVA), which may be foamed, either throughout, or partially. Other possible non-limiting suitable materials include polyurethane and derivatives thereof, polystyrene and derivatives thereof.

Also visible in FIG. 1 is an input/display end 18. The purpose of this input/display end 18 is manual entry and visual display of various aspects and operational parameters of the foam roller 100, which will be described in more detail later with reference to additional figures.

Figure 2A:
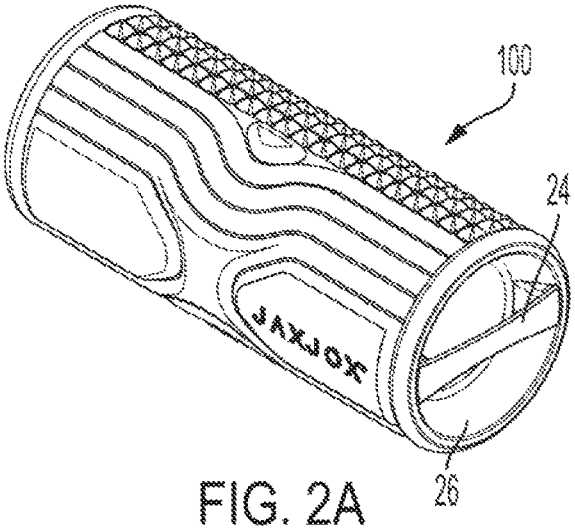

Turn next to FIGS. 2A to 2G, which depict various views of the foam roller 100. FIG. 2A is a perspective view of the foam roller 100. In this perspective view, the handle end 22 is visible. The handle end 22 is the end opposite the input/display end 18 that was visible in the perspective view shown in FIG. 1.

Figure 2D:
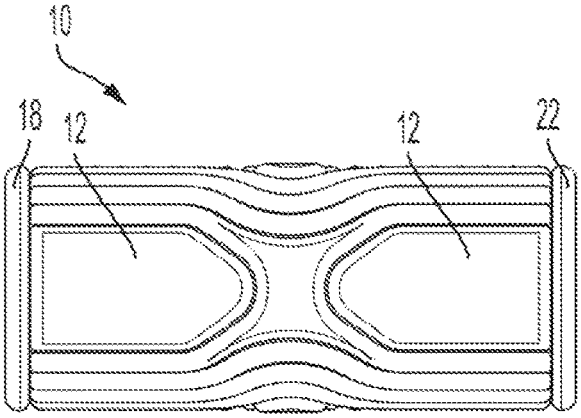
Figure 2E:
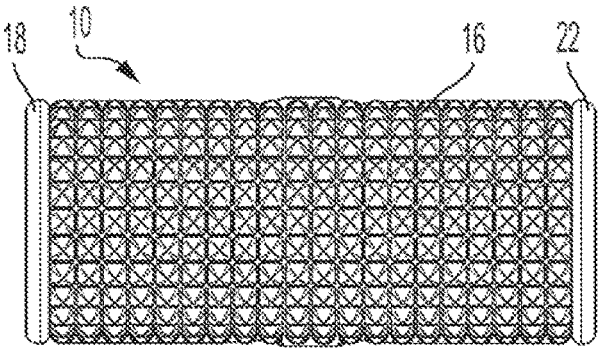
Figure 2B:
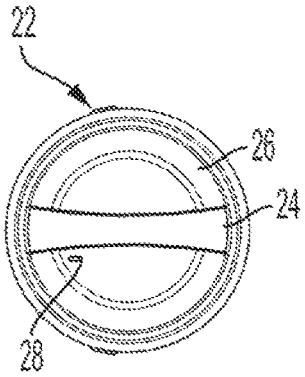
Figure 2F:
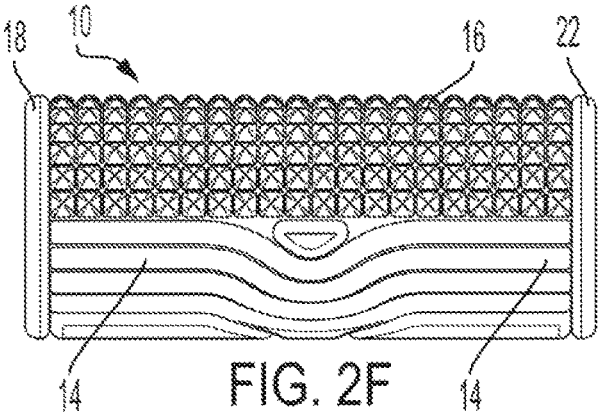

This handle end 22 comprises a handle 24 fixedly attached to a plastic end cap 26, which is itself fixedly attached to the roller 100. As can be appreciated, the handle 24 is configured and arranged so as to provide a convenient way for a user to pick up and carry the roller 100. FIG. 2B shows an end view of the roller 100, which shows the handle 24.

Also shown in the end view of FIG. 2B is an electrical socket 28 in an inlay 32 which is attached to the plastic end cap 26. The electrical socket 28 may be used to provide electrical power from an electrical source to charge an interior battery (not shown). As shown the FIG. 2B, the electrical socket 28 is in the form of a Universal Serial Bus (USB) micro B connection, but other connector types may alternatively be used.

Figure 2C:
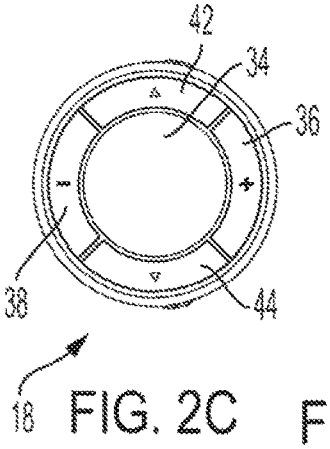
Figure 2G:
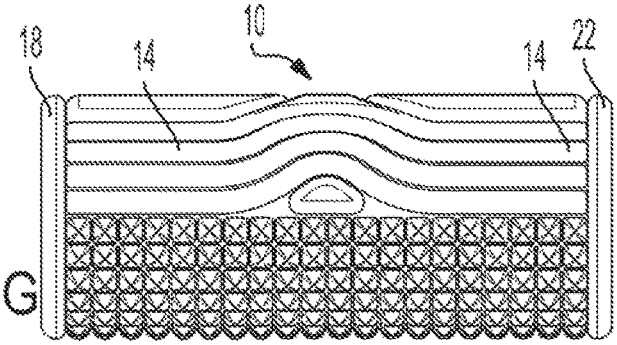

FIG. 2C is an end view of the roller 100 showing the input/display end 18. In the center of the input display end is a display lens 34. The purpose of the display lens 34 is to protect the display module (not shown) which is behind the display lens 34. The display lens 34 is advantageously constructed of a material transparent to visible light. A non-limiting example is poly (methyl methacrylate) and copolymers thereof. The display lens 34 and the display module (not shown) are optional. The display may be provided entirely by way of a wireless connection, e.g. Bluetooth® or Wi-Fi (IEEE 802.11x) to a smartphone or other computing device, for instance.

Surrounding the display lens 34 is an annular button 44, which has four parts that are used for input and scrolling through selection menus. As shown in FIG. 2C these four parts are a plus button 36, a minus button 38, and two scroll buttons 42. Like the display lens 34 and the display module (not shown), these buttons may also be optional, in that input to the foam roller 100 may be entirely controlled by way of a remote computing device such as a mobile device or a smart phone via a remote connection, e.g. Bluetooth® or Wi-Fi.

The shapes of various types of protrusions are illustrated in the figures. For example, FIG. 2D shows the palm protrusions 12, FIG. 2E shows the finger protrusions 16, FIG. 2E shows the finger protrusions 16 and the knuckle protrusions 14, and FIG. 2G likewise shows the knuckle protrusions 14 and the finger protrusions 16.

Figure 3:
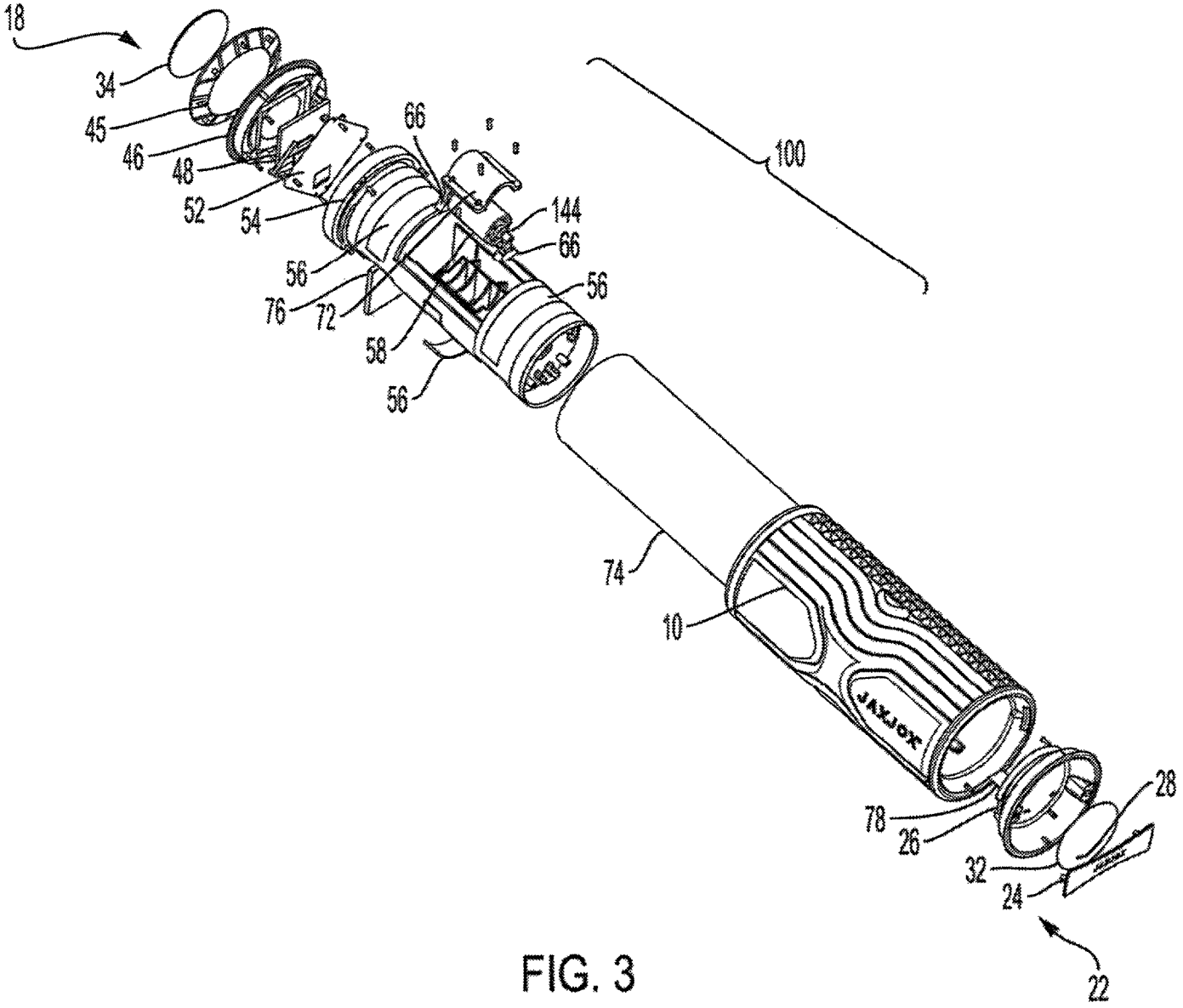

Turn next to FIG. 3, which shows an exploded view of many of the parts of the roller 100. These will be listed and their general attributes discussed in the discussion of FIG. 3 and then further figures are used to show details of the parts' constructions and mechanical operations.

Starting at the input display end 18 of the roller 100, there is shown the display lens 34. Next are the plus button 36, the minus button 38, the scroll buttons 42 and the down button 44. As shown in FIG. 3 these buttons 36, 38, and 42 are connected together as the annular button 44, but they may be separate pieces, as an alternative embodiment. The buttons 36, 38, and 42 fit into a button backing plate 46, which supports and holds the buttons 36, 38, and 42 in place. The button backing plate 46 is also constructed and arranged to hold a display module 48 which interacts with the buttons 36, 38, and 42.

The display module 48 is connected to a main printed circuit board assembly (PCBA) 52. The main PCBA 52 interacts with the display module 48 and the buttons 36, 38, 42, and 44. The main PCBA 52 comprises (at least) a printed circuit board (PCA) (not shown) which comprises (at least), as shown in FIG. 17, a processor 1932, a micro-control unit controller, a memory 1934, and a high speed wireless circuitry network communication interface 1936 such as high speed wireless circuitry wireless transmitter/receiver for transmitting/receiving wireless signals, such as Bluetooth® or Wi-Fi via a wireless network. The high speed wireless circuitry network communication interface 1936 is able to communicate with an exterior computing device 1990 such as a smart phone or other mobile device via a high speed wireless connection 1937.

The display module 48 may comprise, e.g., an image display 50 (shown in FIG. 17) such as a liquid crystal display (LCD), a plasma display panel (PDP), a light emitting diode (LED) display, a projector, or a waveguide. The image display 50 may present various types of images, such as for example in a video.

The main PCB may have a memory 1934, as shown in FIG. 17. The main PCB may also have a wired transmitter/receiver for transmitting and receiving signals through a hardware connection, either instead of, or in addition to, the high speed wireless circuitry wireless transmitter/receiver 1936. The processor 1932 may be programmed in firmware or software to contain a library of vibration regimens, among other functions. A high-level diagram of the components in the main PCB are shown in FIG. 17.

The scroll buttons 42 may thus be used to scroll through choices of completed .exercise activities that are programmed. Plus and minus buttons 36, 38, may be used to increase or decrease intensity of the vibration that is desired, e.g. on a scale of 1 to 5. The buttons may be used by the user to select the desired completed activity or vibration intensity when it appears on the menu in the display, by an action such as pressing the plus and minus buttons 36, 38 at the same time. Likewise, the muscle group that will be subjected to the vibratory/roller massage action from the foam roller 100 may also be input in the same manner. The time that the vibration regimen should last (duration) may also be input by the user using the buttons 36, 38, 42.

Turning briefly to FIG. 15, various vibration .regimens are shown therein as examples of images that may appear on the image display 50. Further explanation of such regimens is provided throughout this disclosure.

Alternatively or in addition, these various functions may be entered wirelessly via Bluetooth® or Wi-Fi, as non-limiting examples, from a remote computing device, such as a smart phone or the Internet or a personal computer, as shown in FIG. 17.

Personal data (also referred to herein as user attributes) relating to the user may also be entered into the processor in much the same way. Non-limiting examples of personal information include weight, height, gender, fitness level. The processor then may utilize all of this information and select a suitable vibration regimen from the programmed library of such regimens. The programming in the PCB may select and display to the user, via the image display 50, or via an external computing device such as a smartphone, or a computer, a suggested muscle group to be subjected to the vibration regimen. The library may reside in a memory on the PCB.

Next is shown an inner core housing 54. As seen in this exploded view, the inner core housing 54 is constructed and arranged to extend nearly the full length of and to fit into the interior of the foam supporting tube 74. The inner core housing 54 is constructed and arranged to hold various components securely within the interior of the roller 100, as shown in more detail in FIG. 7. As can be appreciated by studying FIG. 3, it is apparent that the button backing plate 46 is constructed to fit securely and fixedly into one end of the inner core housing 54. Next are a plurality of pads or fillers such as sponges 56. These sponges 56 are intended to be compression fit around the inner core housing 54 to prevent and cushion undesirable movement of the inner core housing 54 relative to the roller 100.

As can be seen in this exploded view, an electro-mechanical vibration motor 58 is among the components in the interior of the roller 100. The vibration motor 58 may be of the type commonly referred to an electro-mechanical motor, such as those used to generate vibrations output for causing vibrations. Next is a rechargeable battery 76. The battery 76 powers the vibration motor 58 and the main PCBA 52 and its components via wired connections (not shown).The vibration motor 58 is in communication via wire (not shown) with main PCBA 52 and thereby to the (not shown) PCB that controls the rotational or cyclic movement of the vibration motor 58.

Also visible are two eccentric weights 66 that are driven cyclically by the vibration motor 58. These eccentric weights 66 cause the vibration motor 58 to vibrate or generate vibratory movement and thereby effect a vibration of the roller 100, because the vibration motor is fixedly attached to the inner core housing 54 of the roller 100, by way of a motor holder 72. The rate and cycle time of the weights 66 as driven by the vibration motor 58, which is controlled by the programming in the controller on the PCB, thereby creates the intensity of the vibration which may vary over time. The cyclic variation of the vibration over time is referred to as the vibration regimen. The vibration regimen may have an average intensity (i.e., amplitude, as discussed above), which can be changed independently of the cyclic variation of the vibration over time. This average intensity may also be referred to herein as "intensity" or "vibration intensity". The vibration regimen will last for a period of time, e.g. 5 minutes or 30 minutes for example. This period of time is referred to herein as "duration" or "vibration duration". The vibration duration may be selected independently of the vibration regimen. The vibration intensity may be selected independently of the vibration regimen and the vibration duration.

Surrounding the inner core housing 54 is a foam supporting tube 74. The foam supporting tube 74 is cylindrical, hollow and open at both ends. The foam supporting tube 74 is intended to support the foam exterior surface 10. The foam supporting tube 74 is constructed of a strong material able to support the weight of the user during the stretching regimen. A non-limiting example of such a material is acrylonitrile butadiene styrene copolymer (ABS). Surrounding the foam supporting tube 74 is the foam roller surface 10.

Also shown is a charger PCBA 78. The battery 76 is electrically (via a wire, not shown) connected to the charger PCBA 78. The charger PCBA 78 functions to monitor the amount of charge in the battery 76, to make sure that it is not over-charged and to send an alert signal to the display module 48 indicating that the battery 76 is low on power. The charger PCBA 78 is electrically connected (via a wired connection, not shown) to the electrical socket 28 located in the inlay 26.

The plastic end cap 26, as well as the handle 24 are also shown. Although not shown, the roller 100 may optionally comprise a heating element, which is also connected to the main PCBA 52 and which may be turned on and off and set to various levels, as controlled by the processor in the PCB, in a manner analogous to that described for the motor 58. In an alternative embodiment the battery 76 may be located nearer the handle end 22 of the foam roller 100. In this embodiment, the operational aspects are the same.

Figure 4A:
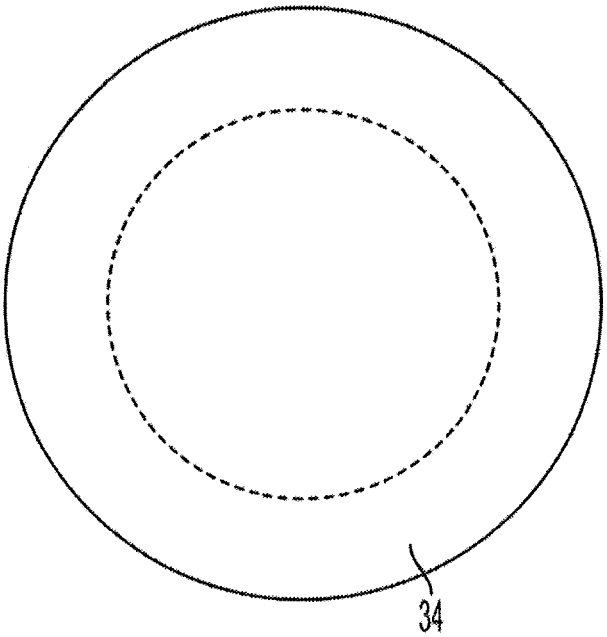
Figure 4B:
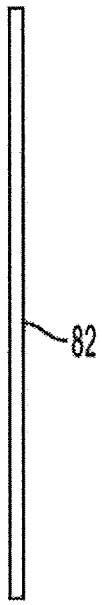
Figure 6A:
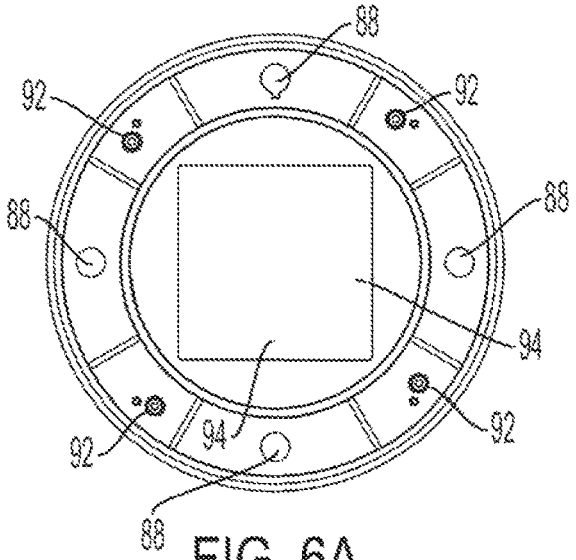
Figure 6B:
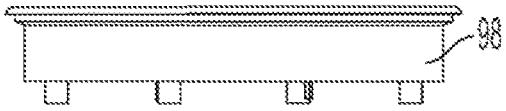
Figure 6C:
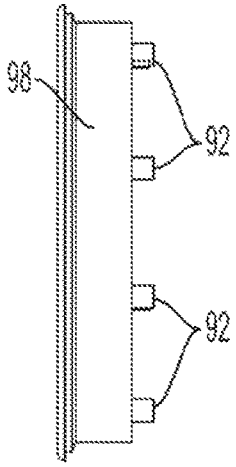
Figure 6D:
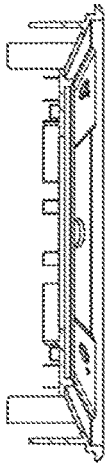
Figure 6E:
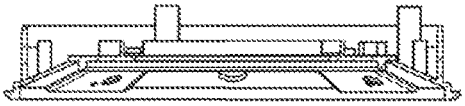
Figure 6F:
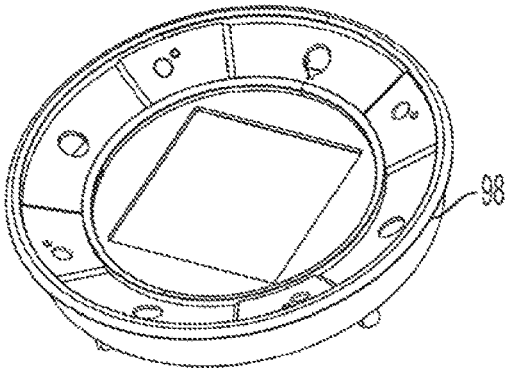
Figure 6G:
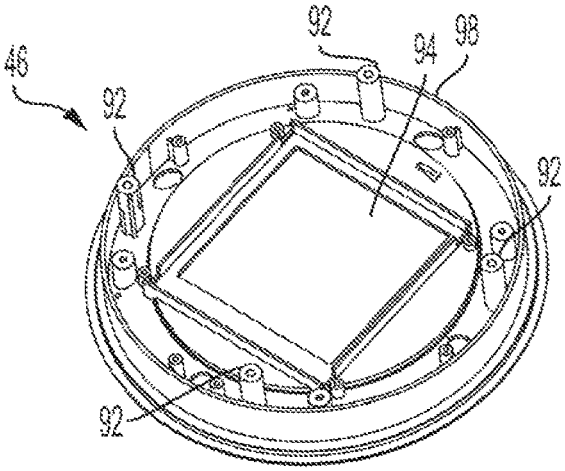
Figure 6H:
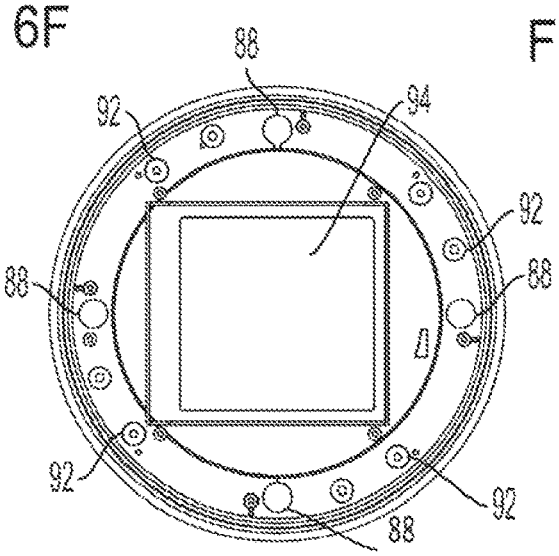

FIGS. 4A and 4B show, respectively, top and side views of the display lens 34. The display lens 34 is advantageously made of a clear plastic such as poly (methyl methacrylate). It can be any thickness, but as shown in FIG. 4B, 1-3 mm is typical. The display lens 34 may be attached to the underlying button backing plate 46 (not shown) and the display module 48 using a clear industrial double sided tape 82, shown in FIG. 4B. This arrangement can be seen more clearly by examining the exploded view FIG. 3.

FIGS. 5A-5E show respectively, top, front side, right side, perspective and bottom views of the button 44. As can be seen by examination of these FIGS. 5A-5E, under and at or near the midpoint each of the button 44 parts, i.e. the minus button 38, the plus button 36, and the two scroll buttons 42 are corresponding respective button projections 84. Also shown are four button legs 86 that are likewise located on the underside of the button 44. As can be seen in FIGS. 5A-5D these button legs 56 are interposed between the button projections 84, i.e. generally under but between each of the buttons 38, 38 and 42. This arrangement is shown clearly in FIG. 5E which shows the underside (bottom) of the button 44.

Turn next to FIGS. 6A-6H, which show top (6A), front (6B), side (6C), cross-section through the line A-A (6D), cross-section through line B-B (6E), top perspective (6F), bottom perspective (6G), and bottom (6H) views of the button backing plate 46 Shown in these FIGS. 6A-6H are four button projection apertures 88 in the button backing plate 46. Also shown are four button leg receptacles 92. As can be appreciated by comparing FIGS. 5 with FIGS. 6, it is apparent that the button projection apertures 88 are constructed and arranged so as to accept the four button projections 84. Looking briefly at FIG. 3, one can see that the button projections 84 can thus pass through the button projection apertures 88 and thereby contact the main PCBA 52, since the main PCBA 52 extends beyond the edges of the display module 48. Accordingly, when the user presses on the buttons 36, 38, and 42, the button projections then press upon and thereby communicate with the main PCBA 52.

Also one can see by examination of FIGS. 5 and 6 that the button leg receptacles 92 are constructed and arranged to accept the button legs 86 located on the underside of the button 44. Thus, the button 44, comprising buttons 36, 38, and 42, is attached to the button backing plate 46. Further, note that there is a display aperture 94 in the center of the button backing plate 46. Turning back to FIG. 3, one can understand that the display aperture 94 is constructed and arranged so that the display module 48 is held is place and thus the image display 50 would be visible through the display aperture 94. In addition, as alluded to briefly above, the display aperture 48 permits the double sided adhesive tape 82 on the display lens 34 to contact and adhere to both the button backing plate 46 and the display module 48, thereby fastening together the display lens 34, the button backing plate 46 and the display module 48. The button backing plate 46 also has an annular lip 98 circumferentially located around the bottom.

Looking at FIG. 3, it can be seen that the lip 98 is constructed and arranged to fit snugly into a button end. 108 (shown in FIG. 7) of the inner core housing 54. The display module 48 is thus also held in place behind the display aperture and in the button end 108 of the inner core housing 54. Looking closely again at FIG. 3, it is apparent that there is a conductive clip 102 on the display module 48 that when clipped through a clip socket 104 on the main PCBA 52, serves to connect together mechanically and electrically the display module 46 and the main PCBA 52.

Figure 7A:
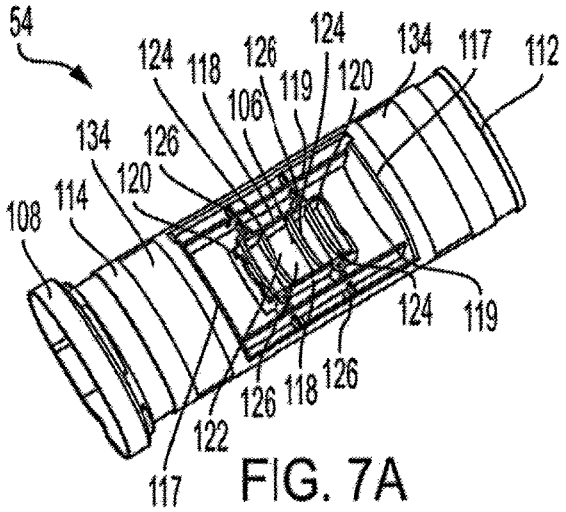

FIG. 7A shows a top perspective view of the center core housing 54. As can be seen in FIG. 7A, the center core housing 54 comprises in its central portion a motor container 106. On one end of the center core housing 54 is a circular button end frame 108. The button end frame 108 is constructed and arranged to accept and securely hold the button backing plate 46 (not shown). On the opposite end of the center core housing is a circular handle end frame 112, which is generally parallel to the button end frame 108. The handle end frame 112 is constructed and arranged to accept and securely hold the plastic end cap 26. As can be seen in FIG. 7A, the button end frame 108 and the handle end frame 112 are connected together by an inner core frame 114.

As can be seen in the various views in FIGS. 7A-7I, the inner core frame 114 is generally hollow and generally cylindrical and is constructed and arranged to not only connect the two ends 108, 112 of the inner core housing 54, but also to comprise three cut-outs 116, so as to retain stiffness but also to minimize the weight of the inner core housing 54. The inner core frame 114 also comprises on its outer surface, cavities 134 for accommodating sponges or alternative pad components. These sponge cavities 134 are arranged to hold sponges 56 in this embodiment. Thus, one can appreciate from perusal of FIG. 3 that when the foam roller 100 is assembled, the sponges 56 are thus held in place in their respective sponge cavities 134 between the outer surface of the inner core housing 54 and the inner surface of the foam supporting tube 74. These sponge cavities 134 are shown in the top perspective view FIG. 7A, the top view FIG. 7B, the side view FIG. 7C, the bottom view FIG. 7D, and the bottom perspective view FIG. 7I.

Figure 7B:
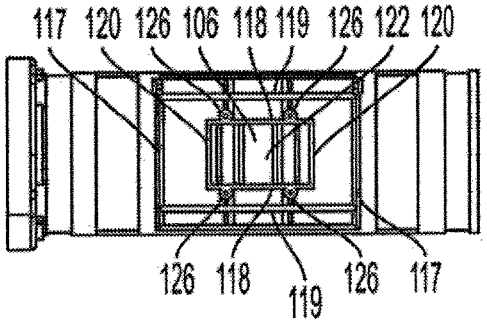

Turning next to FIG. 7B, the top view of the center core housing 54, one can see that the motor container 106 is defined on two sides by motor container ends 120 which are generally perpendicular to the sides of the inner core frame 114. On the other two sides, which are generally parallel to the sides of the inner core frame 114, the motor container 106 is defined by two motor container side walls 118. These motor container sidewalls 118 are attached to the motor container ends 120. Thus the two motor container ends 120 and the sidewalls 118 define the motor container 106.

Turning back to FIG. 7A, the center core housing 54 further includes two reinforcing disks 117 that are generally parallel to each other and are located on either side of the motor container 106, between the button end frame 108 and the handle end frame 112. These two reinforcing disks 117, in addition to being connected to the sides of the inner core frame 114, are connected by two struts 119. These reinforcing disks 117 and the two struts 119 are visible also in FIG. 7B.

Figure 7C:
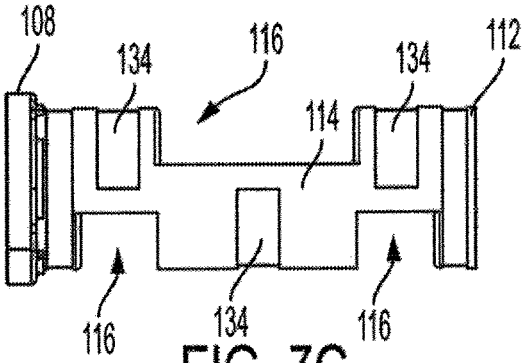
Figure 7D:
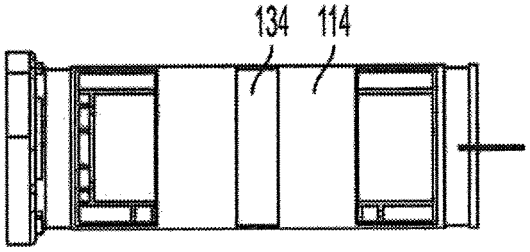
Figure 7E:
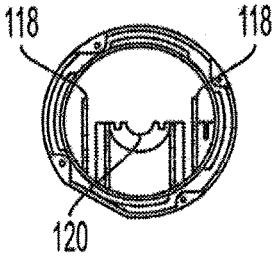
Figure 7F:
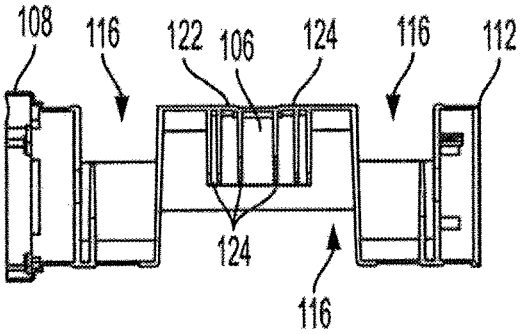

Looking next at FIG. 7F, a cross-sectional view of the inner core housing 54 taken along the line A-A in FIG. 7B, it is apparent that the motor container 106 further has a bottom 122. This bottom 122 may also been seen in FIG. 7A and FIG. 7B.

Looking again at FIG. 7A, 7B and 7F, one can see that inside the motor container 106 are a series of ribs 124. These ribs 124 serve to support the vibration motor 58 (not shown), since these ribs 124 not only extend between the motor container sidewalls 118, but also are attached to the interior of the inner core frame 114, as shown in the cross-sectional view 7F. Note also that outside the motor container sidewalls 118 are fastener receptacles 126. As is shown in FIG. 8 and will be described in more detail, these fastener receptacles 126 are intended to receive fasteners (not shown) that secure the motor holder 72 (shown in FIGS. 8) to the motor container 106, thereby fastening the vibration motor 58 (not shown) securely to the inner core housing 54. Looking closely at the fastener receptacles 126 as shown in FIG. 7A, it is apparent that the fastener receptacles 126 are each mounted to a strut 119. Thus, the receptacles 126 further serve to connect the motor container 106 and thereby to connect the vibration motor 58 (not shown) to the inner core housing 54. In this way, when the vibration motor 58 is operational and vibrates, the inner core housing 54 will likewise vibrate.

FIG. 7E is a side cross-sectional view of the inner core housing 54 taken along line B-B in FIG. 7C. FIG. 7E shows a cross-section of the motor container sidewalls 118, and a side view of the motor container ends 120. The motor container bottom 122 is shown in cross-section in FIG. 7F. FIG. 7F is a cross-sectional view of the inner core housing 54 taken along the line A-A in FIG. 7B. Note that FIG. 7F may be considered to be a view from underneath, since FIG. 7B is the top view. As can be seen in FIG. 7F in cross-section, it is apparent that the motor container bottom 122, the motor container sidewalls 118, the motor container ends 120, the inner core frame 114, the button end frame 108, and the handle end frame 112 are all connected. By examination of FIGS. 7 and FIG. 3 together, also note that the generally circular button end frame 10$, and the handle end frame 112, and the inner core frame 114 are sized such that they fit snugly into the interior of the hollow cylindrical foam supporting tube 74, when the roller 100 is fully assembled.

Figure 7G:
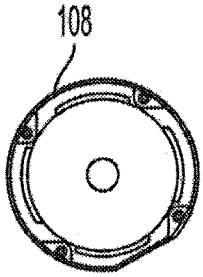
Figure 7H:
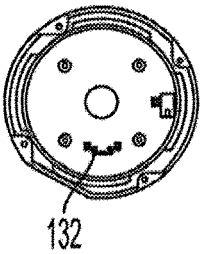
Figure 7I:
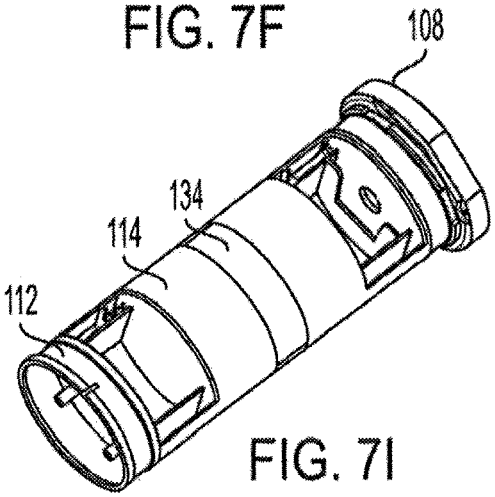

FIG. 7G is an end view of the inner core housing 54 showing the button end frame 108 and 7H is an end view of the inner core housing 54 showing the handle end frame 112. Visible also in FIG. 7H is a charger PCBA clip 132. The charger PCBA clip 132 is electrically conductive and serves to electrically connect the charger PCBA 78 to the battery 76 via a wire (not shown). As can be appreciated by reference to FIG. 3, the charger PCBA clip 132 is also in electrical contact with the electrical socket 28 (not shown) in the inlay 32 (not shown). Thus, a source of electricity may be attached to the socket 28 and thereby charge the battery 76. The battery 76 connects to and powers the vibration motor 58 via a wire (not shown). The purpose of the charger PCBA 78 is to control and monitor the charging of the battery 76, to make sure it is not over-charged, and to send a signal to the main PCBA 52, which then signals the display module 48 to let the user know via the image display 50 the status of the charge to the battery. The main PCBA 52 may also or alternatively send a signal to the external computer device 1990 such as a smart phone (shown in FIG. 17) regarding the charge status of the battery 76.

Figure 8A:
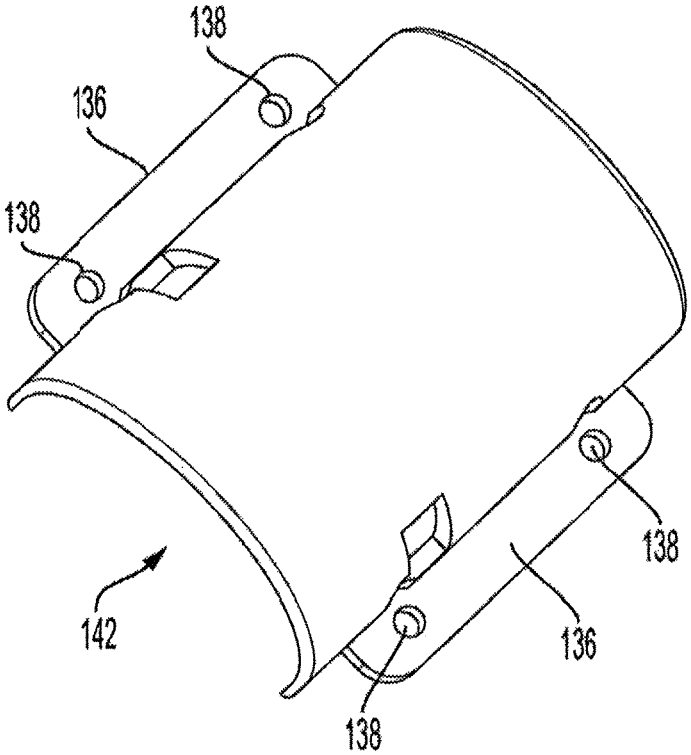
Figure 8B:
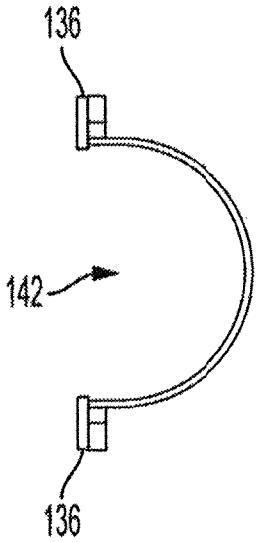
Figure 8C:
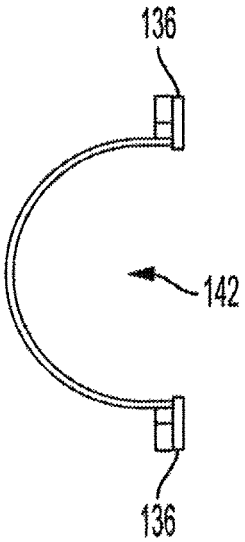

Turn next to FIGS. 8, which shows the motor holder 72. As alluded to briefly in the discussion of FIGS. 7, the purpose of the motor holder 72 is to secure the vibration motor 58 in place in the motor container 106 located in the inner core housing 54. FIG. 8A is a perspective view of the motor holder 72, showing that the motor holder 72 has a pair of flanges 136. In each flange 136 are fastener through holes 138. The fastener through holes 138 are seen in perspective view 8A as well as top view 8B and bottom view 8C. Turning back to FIGS. 7, examination of perspective view FIG. 7A, shows that these through holes 138 are arranged to correspond with respective fastener receptacles 126 on the motor container sidewalls 118. A fastener (not shown) may be inserted into each through hole 138 and secured into each fastener receptacle 126, thereby securing the vibration motor 58 into the inner core housing 54. As can be seen in the perspective view of FIG. 8A, as well as the two side views, 8B and 8C, the motor holder 72 may be generally semi-cylindrical in shape, although any suitable shape is contemplated. Also apparent in FIGS. 8A, 8B and 8C are shaft openings 142 in each side 144 of the motor holder 72.

Examination of FIG. 3, FIG. 7 and FIG. 8 together, reveals that when the vibration motor 58 is fastened in place, motor shafts 144 protrude through the shaft openings 142. Fastened to each motor shaft 144 are the eccentric weights 66. The eccentric weights 66 are driven by the vibration motor 58 via the motor shafts 144 and as they, move back and forth cause the vibration motor to vibrate or generate vibratory movement. Since the motor container bottom 122, the motor container sidewalls 118, the motor container sides 120, the inner core frame 114, the button end frame 108, and the handle end frame 112 are all connected and are in snug contact with the interior of the hollow cylindrical foam supporting tube 74, when the eccentric weights 66 cause the vibration motor 58 to vibrate, the entire roller 100 will thereby vibrate. The speed, frequency, period, etc. of the vibration motor 58 movement are controlled by the controller in the main PCBA 52, which thereby controls the frequency and intensity of the vibration of the roller 100.

Figure 9B:
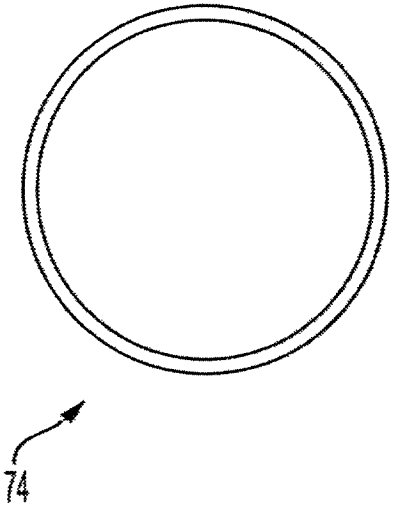
Figure 9A:
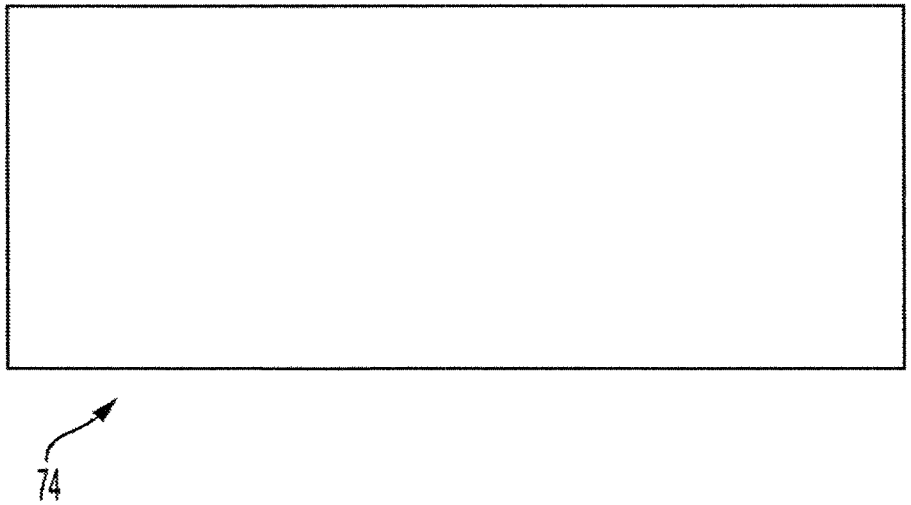

FIGS. 9A and 9B show top and end views of the foam supporting tube 74. The foam supporting tube 74 is a hollow cylinder which is open at both ends and has a hollow interior 146, as well as exterior surface 148. The foam supporting tube is constructed of a suitable rigid tough material of sufficient thickness to withstand the bodyweight of the user of the roller 100. A non-limiting example of a suitable material is acrylonitrile butadiene styrene copolymer, also referred to as ABS. The foam supporting tube 74 is constructed and arranged so that the inner core housing 54 fits snugly into the hollow interior 146 of the foam supporting tube 74. The foam roller surface 10 likewise fits tightly around the exterior surface 148 of the foam supporting tube. Examination of FIG. 3 together with FIG. 7 and FIG. 9 show that the sponges 56 will compress slightly and provide thus ensure a tight fit between the inner core housing 54 and the foam supporting tube 74, so that when the vibration motor 58 is operational, the vibration therefrom is transferred effectively to the inner core housing 54, then to the foam supporting tube 74 and finally to the foam roller surface 10.

Figure 10A:
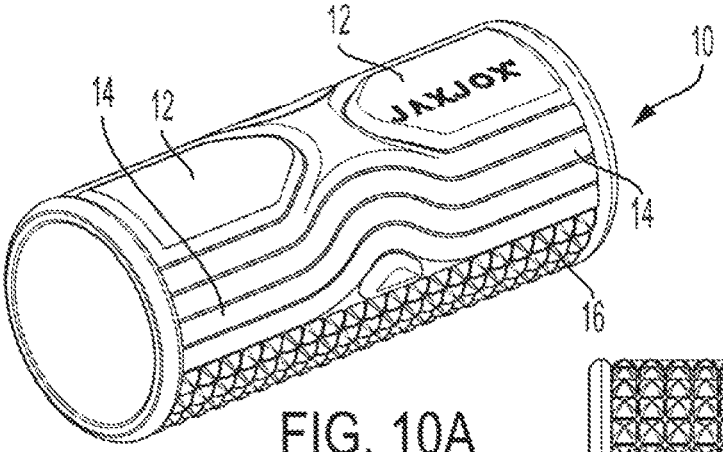
Figure 10B:
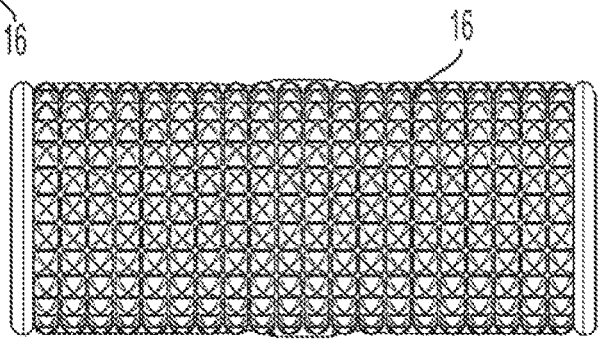
Figure 10C:
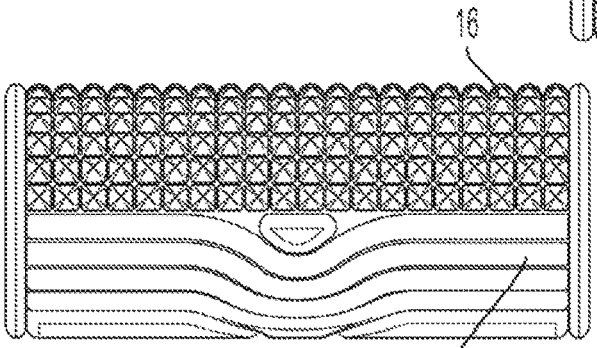
Figure 10D:
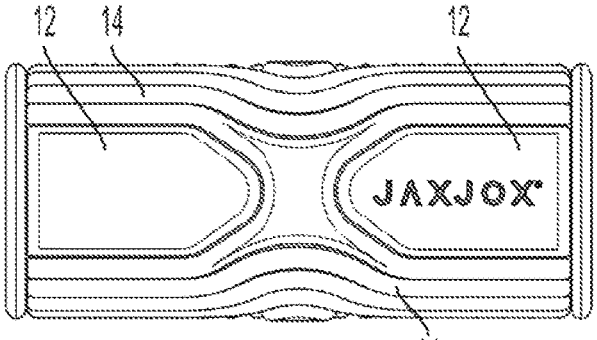
Figure 10F:
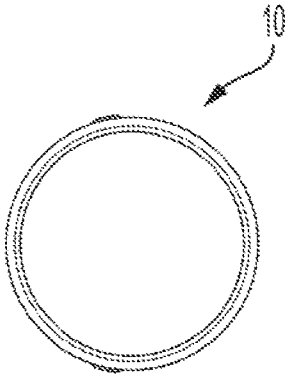
Figure 10E:
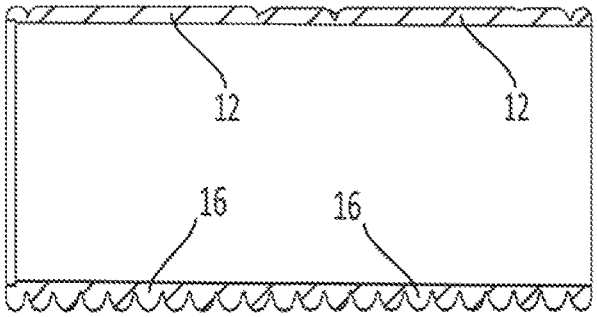

FIGS. 10A-10F show a number of views of the foam exterior surface 10. As discussed previously, the foam exterior surface 10 comprises generally three textures, each texture being composed of finger protrusions 16, knuckle protrusions 14, and palm protrusions 12. These are all visible in the perspective view, FIG. 10A. The bottom view, FIG. 10B shows the finger protrusions 16, while front view FIG. 10C shows the finger protrusions 16 and the knuckle protrusions 14. The top view FIG. 10D shows the knuckle protrusions 14 and palm protrusions 12. Cross-sectional view FIG. 10E, taken along the line A-A in FIG. 10D, thus shows the cross-sectional profiles of the palm protrusions 12 and finger protrusions 16. FIG. 10F is an end view of the foam exterior surface 10. As mentioned previously, the foam roller surface is constructed and arranged to fit tightly around the exterior 148 of the foam support tube 74.

Figure 11A:
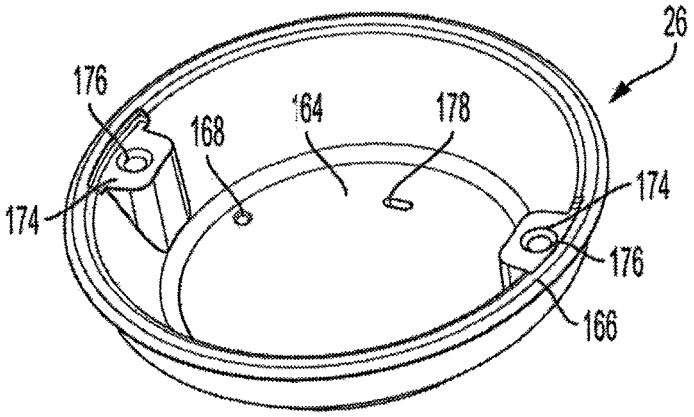
Figure 11B:
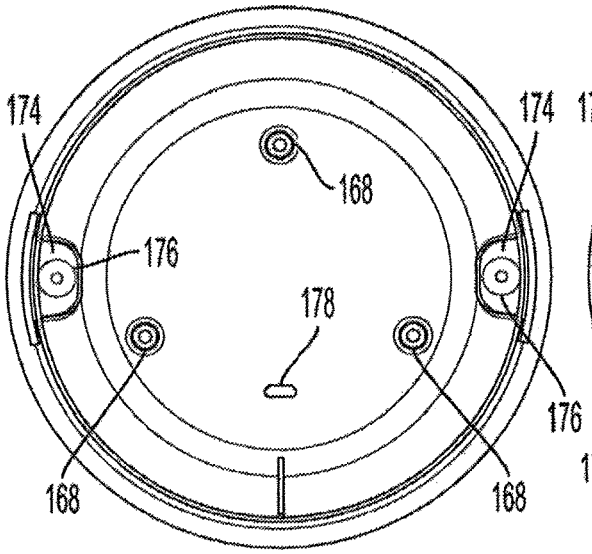
Figure 11C:
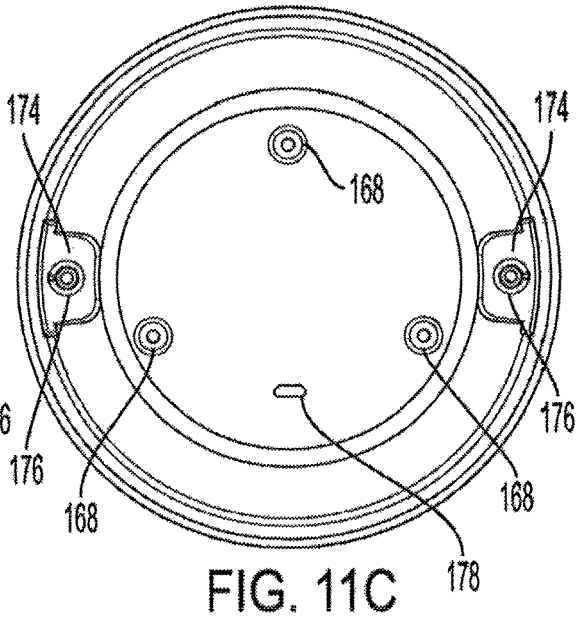

FIGS. 11A-11F show views of the plastic end cap 26. FIG. 11A is a perspective view of the plastic end cap 26. As can be seen in this view, the plastic end cap 26 defines a bowl shape, having a flat bottom 164 and a circumferential lip 166. The circumferential lip 166 will rest on the outer edge of the handle end frame 112 of the inner core housing 54, when the roller 100 is assembled. Note there are three counter-sunk fastener through holes 168 in the flat bottom 164. These through holes 168 are also shown in the top view, FIG. 11B and the bottom view, FIG. 11C, as well as the front view 11D and side view 11E.

Figure 11D:
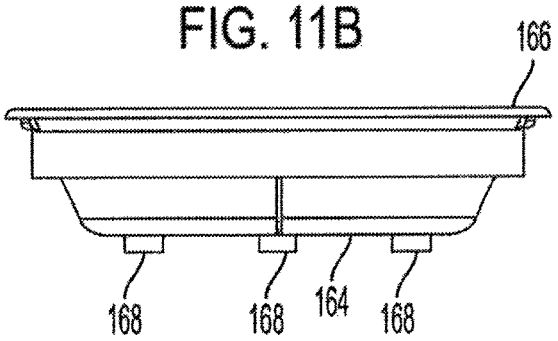
Figure 11E:
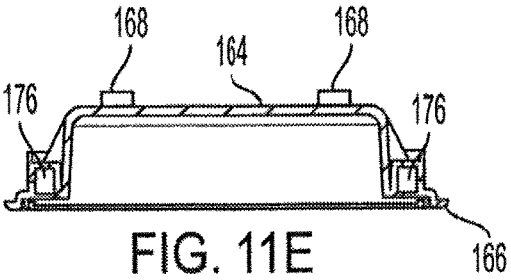
Figure 11F:
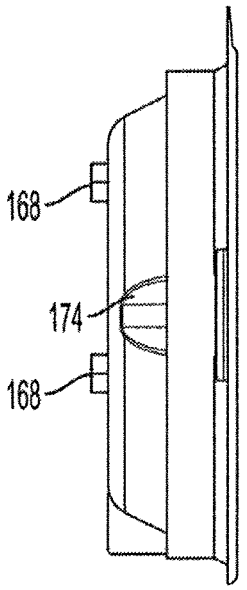

Turning back to FIG. 7H it is apparent that these through holes 168 match up to respective fastener receptacles 172 in the handle end frame 112 of the inner core housing 54. When fasteners (not shown) are inserted through the through holes 168 and inserted into the receptacles 172, the plastic end cap 26 is thereby secured to the inner core housing 54. Also visible in FIG. 11A are two handle support projections 174. These handle support projections 174 each have a handle fastener receptacle 176. The handle support projections 174 and handle fastener receptacles 176 are shown also in FIGS. 11B and 11C. The handle fastener receptacles 176 also are shown in cross-section in FIG. 11E, which is a cross-sectional view of the plastic end cap 26 taken along the line A-A in FIG. 11B. FIG. 11D is a side view of the plastic end cap 26. Notice that there is an electric socket aperture 178 in the flat bottom 164. As shown in the FIGS. 11, this electric socket aperture 178 is shaped to accept a micro USB plug, but could be any shape to fit electric supply plugs as are known and used in the art.

Turn to FIGS. 12A and 12B, which show top and side views of the inlay 32. The inlay 32 may be made of a tough thermoplastic such as polycarbonate. The inlay 32 may be decorated with a silk-screened image. As seen in FIG. 12A the inlay 32 is a thin disk and is constructed and sized to fit onto the flat bottom 164 of the plastic endcap 26, as shown in FIGS. 11. The inlay 32 may be 0.25 mm thick, for instance. Also shown in FIG. 12A is an electric socket aperture 182. This electric socket aperture 182 is positioned and sized to coincide with the electric socket aperture 178 in the flat bottom 164, shown in FIG. 11A, for instance. The inlay 32 may be secured to the flat bottom of the plastic end cap 26 with a layer of double sided industrial adhesive tape 184.

FIGS. 13A-13D illustrate top, side, front and bottom views, respectively, of the handle 24. One may appreciate by examination of FIG. 11 and FIG. 13, these fastener projections 186 are located and configured to fit tightly into the fastener receptacles 176 on the plastic end cap 26, thereby attaching the handle 24 to the plastic end cap 26.

FIGS. 14A and 14B show a view of the button end 18 of the roller and a top view of the roller 100. As can be seen in the view of the button end 18 of the roller, the image display 50 is displaying a choice of a completed activity (e.g., strength training) that the user may select, via the buttons 36, 38, 42, from a menu of choices (shown in FIG. 15) that is programmed into the main PCBA 52. Note also that the display 50 displays symbols 192 relating to the input/output mode, e.g., wireless or wired.

FIG. 15 illustrates a series of images of the display 50 showing possible menu choices that the user may choose from when using the roller 100. As shown in FIG. 15, the display 50 is blank 194 when the roller 100 is OFF. When the roller 100 is turned on, the display 50 then reads READY 196. When the display 50 displays READY 196, the user may then select from the ACTIVITY 198 or INTENSITY 202, by pressing appropriately on the buttons 36, 38, 42. As shown in FIG. 15 vibration intensity choices 204 are from LEVEL 1 to LEVEL 5. As shown in FIG. 15, non-limiting examples of activities 206 from which the user may select are: leisure, massage, strength, hike, cycle, or run. Other menus and menu items from which a user may select are, a user profile, the length of time that the user wants the vibration regimen to continue, the muscle group to be subjected to the vibration regimen, and combinations of those choices.. Although not shown, a user may select a heating level, if the roller 100 comprises an optional heating element.

FIG. 1,6 illustrates a logic flowchart diagram illustrating the method of using the roller 100. Starting at the left side of FIG. 16, at the starting block 208 of the flowchart, when the roller 100 is turned on, the image display 50 shows READY in the next block 210. When READY is displayed, the user may then move to block 212 and select type of user, either a new user or a stored user, meaning that the user attributes were previously entered. If the user selects New user, meaning that the user's personal data is not stored in memory 1934 (shown in FIG. 17), the user then moves to block 214 and enters user attributes. The user attributes, i.e. user data, is stored in the memory 1934. If the user selects stored user in block 212, the user moves to block 218. In block 218, the must then select which stored user information, i.e. "stored ID" to be used.

Next, whether the user has selected stored user data or new user data, the user then moves to block 222 and selects from manual or auto operation. If the user selects manual operation, the user moves to block 224 and selects the vibration regimen desired, the duration that the vibration regimen should last, the intensity of the vibration regimen, and optionally a heat setting. If the user selects automatic "auto" operation of the roller 100, the user moves to block 226 and enters the activity performed. FIG. 15 shows non-limiting examples of activities which the user may select from: e.g., leisure, massage, strength, hike, cycle, or run.

If the user selects auto operation, the user then goes to block 226 and enters the activity performed. A processor 1932 (shown on FIG. 17) located preferably on the main PCBA 52 (as shown in FIG.17) determines the appropriate vibration regimen, from a library of such regimens stored in memory 1934 (shown in FIG.17) located on the main PCBA 52. The processor 1932 determines the appropriate vibration regimen depending on the activity that the user selected, as well as the user attributes (also called user data), such as sex, level of fitness, and weight of user. The processor 1932 may optionally also determine which muscle group should be targeted by the roller 100.

The processor 1932 uses the performed exercise activity selected in block 226 to determine which muscle group to target. The processor 1932 then outputs as shown in block 232 the suggested targeted muscle group to the display 50 or to an external device such as a smart phone 1990 (shown in FIG. 17), or to both the display 50 and the external device 1990. The next step is block 234, whether manual or auto was selected in block 222. In block 234, the processor 1932 sends a vibratory control signal to the vibration motor 58 and the motor 58 thus performs the vibration regimen for the duration.

When the vibration regimen is completed, the processor 1932 stores the details of the vibration regimen in memory 1934, as shown in block 236. Block 238 shows that the processor 1932 may optionally also output the details of the completed vibration regimen to an external computing device 1990, such as a smart phone or mobile device or a computer. The process then ends as shown in block 242.

FIG. 17 is a high-level functional block diagram of an example of a system such as connection system 1900 including the roller 100 with a roller programming (as shown in FIG. 16) contained in the PCBA 52. Roller programming may include, for example, a library of vibration regimens as well as programming according to the logic in FIG. 16 that selects an appropriate vibration regimen based on input from the user. Generally, the memory 1934 in the main PCBA 52 is pre-programmed with a series of suitable vibration intensities/times/temperature (if temperature is available) sets from which the appropriate set is selected using a pre-programmed method of selection, from the user profile and activity entered by the user. Also included in the connection system 1900 is a mobile device 1990, and a server system 1998 connected via various networks. Roller 100 may be connected with a host computer or a mobile device, 1990 such as a smart phone. For example, the roller 100 is paired with the mobile device 1990 via the high-speed wireless connection 1937 or connected to a server system 1998 via a network 1995. In some examples, the host computer may be a wearable device such as a smartwatch or activity tracker (not shown).

Roller 100 includes the main PCBA 52 and display module 48. The display module 48 may also include or be otherwise directly or indirectly associated with an image display driver 1942, image processor 1912, and a microcontrol unit (MCU) 1932. The display module 48 is for presenting images and videos, which can include a sequence of images. Image display driver 1942 is coupled to image display 50 to present the images. The components shown in FIG. 17 for roller 100, may alternatively be located on the main PCBA 52 or the display module 48 located on-board the roller 100.

Any of the functionality described herein for the roller 100, mobile device 1990, or server system 1998, can be embodied in one more applications or firmware and stored in a machine-readable medium. According to some embodiments, "function," "functions," "application," "applications," "instruction," "instructions," or "programming" are program(s) that execute functions defined in the programs. Various programming languages can be employed to create one or more of the applications, structured in a variety of manners, such as object-oriented programming languages (e.g., Objective-C, Java, or C++) or procedural programming languages (e.g., C or assembly language). In a specific example, a third party application (e.g., an application developed using the ANDROID™ or IOS™ software development kit (SDK) by an entity other than the vendor of the particular platform) may be mobile software running on a mobile operating system such as IOS™, ANDROID™, WINDOWS® Phone, or another mobile operating systems. In this example, the third party application can invoke Application Programming Interface (API) calls provided by the operating system to facilitate functionality described herein.

Hence, a machine-readable medium may take many forms of tangible storage medium. Non-volatile storage media include, for example, optical or magnetic disks, such as any of the storage devices in any computer(s) or the like, such as may be used, to implement the roller 100. Volatile storage media include dynamic memory, such as main memory of such a computer platform. Tangible transmission media include coaxial cables; copper wire and fiber optics, including the wires that comprise a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

Various non-limiting aspects of the invention may be summarized as follows:

Aspect 1: A roller for use during a stretching regimen, the roller comprising:

a cylindrical body having an exterior surface configured for contact with a user of the roller, the cylindrical body at least partially defining an interior;

an electro-mechanical motor positioned at least partially within the interior of the cylindrical body and configured to vibrate the cylindrical body 100 based on a vibratory control signal;

a user input device associated with the cylindrical body 100 and configured for receiving at least one selection, wherein the at least one selection is selected from the group consisting of a physical fitness activity, an intensity level of a vibration, a user profile, and combinations thereof;

a network communication interface positioned at least partially within the interior of the cylindrical body and configured to wirelessly communicate with a remote computing device over a network;

a processor coupled to the electro-mechanical motor, the user input, and the network communication interface;

a memory coupled to the processor; and a stretching regimen program, wherein execution of the stretching regimen program by the processor configures the roller to:

a) receive, via the user input device, from the user, the at least one selection;

b) transmit, over the network, to the remote computing device the at least one selection; and c) receive, over the network, from the remote computing device, stretching regimen control data to drive the electro-mechanical motor based on the at least one selection, adjust a vibratory control signal to the electro-mechanical motor based on the stretching regimen control data to vibrate at least a portion of the cylindrical body, and transmit, over the network, to the remote computing device, data to indicate the completion or incompletion of the stretching regimen.

Aspect 2: The roller for use during a stretching regimen of Aspect 1, wherein the data to indicate the completion or incompletion of the stretching regimen further is used to indicate a progress of the stretching regimen.

Aspect 3: The roller for use during a stretching regimen of either of Aspects 1 and 2, wherein the stretching regimen control data transmitted to the remote computing device further is used to indicate a specific stretching regimen selected from the stretching regimen programming the memory.

Aspect 4: The roller for use during a stretching regimen of any of Aspects 1-3, wherein the roller further comprises a heating element and wherein execution of the stretching regimen programming by the processor further configures the roller to adjust a temperature control signal to the heating element based on the stretching regimen control data to heat at least a portion of the cylindrical body.

Aspect 5: A roller for use during a stretching regimen, the roller comprising:

a cylindrical body having an exterior surface configured for contact with a user of the roller, the cylindrical body at least partially defining an interior;

an electro-mechanical motor to vibrate the cylindrical body based on a vibratory control signal;

a network communication interface positioned within the interior of the cylindrical body and having a receiver configured to receive data corresponding to user attributes associated with the user and having a transmitter configured to transmit data corresponding to user attributes and data corresponding to the specific stretching regimen attributes;

a memory positioned at least partially within the interior of the cylindrical body and configured to store a plurality of stretching regime programs, each of the plurality of stretching regimen programs having characteristics varied based on the user attributes; and a processor positioned at least partially within the interior of the cylindrical body and coupled to the network communication interface and to the memory, the processor being configured to select the stretching regimen program from among the plurality of stretching regimen programs stored in the memory based on the user attributes of the user of the roller, and the processor also being configured to execute the selected stretching regimen program;

wherein the stretching regimen program includes sending the vibratory control signal to the electro-mechanical motor to control a vibration of at least a portion of the cylindrical body.

Aspect 6: The roller according to Aspect 5, wherein the user attributes are selected from the group consisting of an age of the user, a fitness level of the user, a weight of the user, a sex of the user, an activity performed by the user, and combinations thereof.

Aspect 7: The roller according to either of Aspects 5 and 6, wherein the characteristics of the stretching regimen are selected from the group consisting of a duration of the vibration, an intensity of the vibration, a pattern of the vibration, a temperature of the roller, and combinations thereof.

Aspect 8: The roller according to any of Aspects 5-7, wherein the activity performed by the user is selected from the group consisting of leisure, massage, strength, hike, cycle, and run.

Aspect 9: A roller for use during a stretching regimen, the roller comprising:

a cylindrical body having an exterior surface configured for contact with a user of the roller, the exterior surface of the cylindrical body defining a plurality of protrusions extending radially outwardly from the cylindrical body;

wherein the plurality of protrusions includes at least three groups of protrusions, each of the groups of protrusions having at least one protrusion shaped differently from at least one protrusion of the other groups of protrusions; and wherein the different shapes of the plurality of protrusions are selected to provide a different contact with the user.

Aspect 10: The roller of Aspect 9, wherein the different shapes of the plurality of shapes are selected from the group consisting of a finger shape, a knuckle shape, a palm shape, and combinations thereof.

Aspect 11: The roller of either of Aspects 9 and 10, further comprising a heating element.

Aspect 12: The roller of Aspect any of Aspects 9-11, further comprising a motor configured for vibration of the roller.

Aspect 13: A method of providing a stretching regimen to a user, the method comprising:

a) receiving from the user at least one criteria associated with the stretching regimen, the criteria being selected from the group consisting of a physical fitness activity, an intensity level of a vibration, a user profile, and combinations thereof;

b) selecting, based on the at least one criteria, the stretching regimen from among a group of predetermined stretching regimens stored in a memory;

c) transmitting a signal corresponding to the selected stretching regimen to a vibration motor of a stretching roller;

d) activating the vibration motor of the stretching roller to generate vibration corresponding to the selected stretching regimen; and e) transmitting a signal indicating the completion or incompletion of the stretching regimen.

Aspect 14: The method of Aspect 13, further comprising providing to the user the roller for use during the selected stretching regimen, the roller comprising:

a cylindrical body having an exterior surface configured for contact with the user, the cylindrical body at least partially defining an interior;

the vibration motor positioned at least partially within the interior of the cylindrical body and configured to vibrate the cylindrical body based on the signal corresponding to the selected stretching regimen;

a user input associated with the cylindrical body and configured for receiving the at least one criteria;

a network communication interface positioned at least partially within the interior of the cylindrical body and configured to wirelessly communicate with a remote computing device over a network;

a processor coupled to the vibration motor, the user input, and the network communication interface; and a memory coupled to the processor and storing a stretching regimen program and the predetermined stretching regimens.

Aspect 15: The method of either of Aspects 13 and 14, the receiving step including receiving the at least one criteria associated with the stretching regimen at an input of the stretching device.

Aspect 16: The method of any of Aspects 13-15, the transmitting step including transmitting the signal corresponding to the selected stretching regimen from a remote device.

Aspect 17: The method of any of Aspects 13-16, the step of transmitting the signal indicating the completion or incompletion of the stretching regimen including transmitting the signal to a remote device.

Although the invention is illustrated and described herein with reference to specific embodiments, the invention is not intended to be limited to the details shown. Rather, various modifications may be made in the details within the scope and range of equivalents of the claims and without departing from the invention.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A roller for use during a stretching regimen, the roller comprising:

a cylindrical body having an exterior surface configured for contact with a user of the roller, a first end cap positioned to cover a first end of the cylindrical body, and a second end cap positioned to cover a second end of the cylindrical body; the cylindrical body, the first end cap, and the second end cap together defining a closed interior and restricting user access to the closed interior;

an electro-mechanical motor positioned within the closed interior of the cylindrical body and configured to vibrate the exterior surface of the cylindrical body based on a vibratory control signal;

a user input device associated with the cylindrical body and configured for receiving a physical fitness activity completed by the user of the roller;

a network communication interface positioned within the closed interior of the cylindrical body and configured to wirelessly communicate with a remote computing device over a network;

a processor coupled to the electro-mechanical motor, the user input device, and the network communication interface;

a memory coupled to the processor; and a stretching regimen program, wherein execution of the stretching regimen program by the processor configures the roller to:

a) receive, via the user input device, from the user, the physical fitness activity completed by the user of the roller;

b) transmit, over the network, to the remote computing device the physical fitness activity completed by the user of the roller; and c) receive, over the network, from the remote computing device, stretching regimen control data to drive the electro-mechanical motor, wherein the stretching regimen control data is based on the physical fitness activity completed by the user, adjust a vibratory control signal to the electro-mechanical motor based on the stretching regimen control data to vibrate the exterior surface of the cylindrical body, and transmit, over the network, to the remote computing device, data to indicate a completion or an incompletion of the stretching regimen.

2. The roller for use during a stretching regimen of claim 1, wherein the data to indicate the completion or incompletion of the stretching regimen further is used to indicate a progress of the stretching regimen.

3. The roller for use during a stretching regimen of claim 1, wherein the stretching regimen control data transmitted to the remote computing device further is used to indicate a specific stretching regimen selected from the stretching regimen program.

4. The roller for use during a stretching regimen of claim 1, wherein the roller further comprises a heating element and wherein execution of the stretching regimen program by the processor further configures the roller to adjust a temperature control signal to the heating element based on the stretching regimen control data to heat at least a portion of the cylindrical body.

5. The roller of claim 1, wherein the exterior surface of the cylindrical body defines a plurality of protrusions extending radially outwardly from the cylindrical body;

wherein the plurality of protrusions includes at least three groups of protrusions, each of the groups of protrusions having at least one protrusion shaped differently from at least one protrusion of the other groups of protrusions; and wherein the different groups of protrusions of the plurality of protrusions are selected to provide a different contact with the user.

6. The roller of claim 5, wherein the at least one protrusion shaped differently from the at least one protrusion of the other groups of protrusions is selected from the group consisting of a finger shape, a knuckle shape, a palm shape, and combinations of any or all of the finger shape, the knuckle shape, and the palm shape.

7. The roller of claim 5, further comprising a heating element.

8. The roller of claim 1, wherein the first end cap or the second end cap comprises a handle.

9. The roller of claim 1, further comprising an inner core housing fixed to the electro-mechanical motor, a tube surrounding the inner core housing, and at least one pad interposed between the inner core housing and the tube;

wherein the cylindrical body is fitted around the tube and the at least one pad is compressed between the inner core housing and the tube, such that when the electro-mechanical motor is activated, a vibration generated by the electro-mechanical motor is transferred from the electro-mechanical motor to the inner core housing, to the tube, and to the cylindrical body.

10. The roller of claim 1, wherein the first end cap or the second end cap comprises the user input device and/or a display.

11. A method of providing the stretching regimen to the user via the roller of claim 1 for use during the stretching regimen, the method comprising:

a) receiving from the user the physical fitness activity completed by the user;

b) selecting, based on the physical fitness activity completed by the user, the stretching regimen from among a group of predetermined stretching regimens stored in the memory;

c) transmitting the vibratory control signal corresponding to the selected stretching regimen to the electro-mechanical motor of the roller;

d) activating the electro-mechanical motor of the roller to generate vibration corresponding to the selected stretching regimen;

e) transmitting the data indicating the completion or the incompletion of the stretching regimen.

12. The method of claim 11, the receiving step including receiving the physical fitness activity completed by the user at the user input device of the roller.

13. The method of claim 11, the transmitting step including transmitting the vibratory control signal corresponding to the selected stretching regimen from the remote computing device.

14. The method of claim 11, the step of transmitting the data indicating the completion or incompletion of the stretching regimen including transmitting the data to the remote computing device.

15. A roller for use during a stretching regimen, the roller comprising:

a cylindrical body having an exterior surface configured for contact with a user of the roller, a first end cap and a second end cap; the cylindrical body, the first end cap and the second end cap together defining a closed interior and restricting user access to the closed interior;

an electro-mechanical motor located within the closed interior to vibrate the cylindrical body based on a vibratory control signal;

a network communication interface positioned within the closed interior of the cylindrical body and having a receiver configured to receive data corresponding to a physical fitness activity completed by the user of the roller and having a transmitter configured to transmit the data corresponding to the physical fitness activity completed by the user of the roller and data corresponding to specific stretching regimen characteristics;

a memory positioned within the closed interior of the cylindrical body and configured to store a plurality of stretching regimen programs, each of the plurality of stretching regimen programs having stretching regimen characteristics varied based on the physical fitness activity completed by the user of the roller; and a processor positioned within the closed interior of the cylindrical body and coupled to the network communication interface and to the memory, the processor being configured to select a stretching regimen program from among the plurality of stretching regimen programs stored in the memory based on the physical fitness activity completed by the user of the roller and the specific stretching regimen characteristics, and the processor also being configured to execute the selected stretching regimen program;

wherein the stretching regimen program includes sending the vibratory control signal to the electro-mechanical motor to control a vibration of at least a portion of the cylindrical body.

16. The roller according to claim 15, wherein the data corresponding to the user further comprises an age of the user of the roller and a fitness level of the user of the roller.

17. The roller according to claim 15, wherein the characteristics of the stretching regimen are selected from the group consisting of a duration of the vibration, an intensity of the vibration, a pattern of the vibration, a temperature of the roller, and combinations of any or all of the duration of the vibration, the intensity of the vibration, the pattern of the vibration, and the temperature of the roller.

18. The roller according to claim 15, wherein the physical fitness activity completed by the user of the roller is selected from at least two different physical fitness activities in the group consisting of strength training, hiking, cycling, and running.

19. The roller of claim 15, wherein the first end cap or the second end cap comprises a handle.

20. The roller of claim 15, further comprising an inner core housing fixed to the electro-mechanical motor, a tube surrounding the inner core housing, and at least one pad interposed between the inner core housing and the tube;

wherein the cylindrical body is fitted around the tube and the at least one pad is compressed between the inner core housing and the tube, such that when the electro-mechanical motor is activated, the vibration generated by the electro-mechanical motor is transferred from the electro-mechanical motor to the inner core housing, to the tube, and to the cylindrical body.

21. The roller of claim 15, wherein the first end cap or the second end cap comprises the user input device and/or a display.

* * * * *